US009132664B2

(12) United States Patent
Schach

(10) Patent No.: US 9,132,664 B2
(45) Date of Patent: Sep. 15, 2015

(54) DEVICE AND METHOD FOR ADDING INFORMATION ON THE OUTER SURFACE OF ARTICLES, SUCH AS CONTAINERS IN A CONTAINER FILLING PLANT

(75) Inventor: Martin Schach, Bochum (DE)

(73) Assignee: KHS GmbH, Dortmund (DE)

( * ) Notice: Subject to any disclaimer, the term of this patent is extended or adjusted under 35 U.S.C. 154(b) by 88 days.

(21) Appl. No.: 13/555,231

(22) Filed: Jul. 23, 2012

(65) Prior Publication Data

US 2013/0019566 A1 Jan. 24, 2013

Related U.S. Application Data

(63) Continuation of application No. 12/698,638, filed on Feb. 2, 2010, now abandoned, and a continuation-in-part of application No. PCT/EP2008/005711, filed on Jul. 12, 2008.

(30) Foreign Application Priority Data

| | | |
|---|---|---|
| Aug. 3, 2007 | (DE) | 10 2007 036 752 |
| Oct. 19, 2007 | (DE) | 10 2007 050 490 |
| Oct. 19, 2007 | (DE) | 10 2007 050 493 |

(51) Int. Cl.

| | |
|---|---|
| ***B41J 3/00*** | (2006.01) |
| ***B41J 3/407*** | (2006.01) |
| ***B41J 2/005*** | (2006.01) |
| ***B41J 3/54*** | (2006.01) |
| ***B41J 11/00*** | (2006.01) |

(52) U.S. Cl.

CPC ..... *B41J 3/4073* (2013.01); *B41J 2/0057* (2013.01); *B41J 3/543* (2013.01); *B41J 11/002* (2013.01); *B41J 11/0015* (2013.01)

(58) Field of Classification Search

CPC ..... B41J 3/4073; B41J 3/407; B41J 3/28
USPC ..... 347/2, 4; 53/411; 101/44
See application file for complete search history.

(56) References Cited

U.S. PATENT DOCUMENTS

| | | | |
|---|---|---|---|
| 3,641,930 | A | 2/1972 | Riddington |
| 3,765,326 | A | 10/1973 | Hawkins |
| 3,877,367 | A | 4/1975 | Norwood |

(Continued)

FOREIGN PATENT DOCUMENTS

| | | | |
|---|---|---|---|
| CA | 1277176 | C | 12/1990 |
| DE | 4424528 | | 1/1996 |

(Continued)

OTHER PUBLICATIONS

International Search Report EP/2008/005711 and English translation thereof.

(Continued)

*Primary Examiner* — An Do
(74) *Attorney, Agent, or Firm* — Nils H. Ljungman & Associates

(57) ABSTRACT

A method and device for printing containers in multiple colors on at least one outer surface thereof. The device includes at least one printing group, with at least two ink jet print heads in each printing group. Each of the print heads is designed to be moved out of the printing position after completing a printing task, and then another print head is moved into the printing position to perform a printing task.

20 Claims, 24 Drawing Sheets

(56) References Cited

U.S. PATENT DOCUMENTS

| | | | | |
|---|---|---|---|---|
| 3,934,500 | A | 1/1976 | Jackson | |
| 3,960,073 | A | 6/1976 | Rush | |
| 4,078,483 | A | 3/1978 | Gall | |
| 4,981,547 | A | 1/1991 | Zodrow et al. | |
| 5,110,402 | A | 5/1992 | Zodrow et al. | |
| 5,207,153 | A | 5/1993 | Thomason | |
| 5,207,155 | A | 5/1993 | Thompson | |
| 5,784,171 | A | 7/1998 | Kano | |
| 6,058,985 | A | 5/2000 | Petri et al. | |
| 6,439,368 | B1 | 8/2002 | Kortge | |
| 6,463,964 | B2 | 10/2002 | Clusserath | |
| 6,666,937 | B2 | 12/2003 | Weder et al. | |
| 6,769,357 | B1 | 8/2004 | Finan | |
| 7,404,277 | B2 * | 7/2008 | Schach et al. | 53/136.1 |
| 8,256,854 | B2 * | 9/2012 | Till | 347/2 |
| 2004/0252174 | A1 | 12/2004 | Baxter et al. | |
| 2005/0045053 | A1 | 3/2005 | Finan | |
| 2006/0144261 | A1 | 7/2006 | Uptergrove | |
| 2006/0250464 | A1 | 11/2006 | Sheinman | |
| 2007/0157559 | A1 | 7/2007 | Till | |
| 2008/0019029 | A1 | 1/2008 | Raymond et al. | |

FOREIGN PATENT DOCUMENTS

| | | | |
|---|---|---|---|
| DE | 102005041221 | | 3/2007 |
| DE | 102006001223 | A1 | 7/2007 |
| DE | 102007036752 | | 2/2009 |
| EP | 0 209 896 | A | 1/1987 |
| EP | 0 385 624 | A | 9/1990 |
| EP | 1435296 | A1 | 7/2004 |
| EP | 1449778 | | 8/2004 |
| EP | 1493339 | | 1/2005 |
| JP | 5185661 | A | 7/1993 |
| JP | 9174900 | A | 7/1997 |
| JP | 2001 018362 | A | 1/2001 |
| JP | 2002 166532 | A | 6/2002 |
| JP | 2005 014255 | A | 1/2005 |
| JP | 2005 531428 | A | 10/2005 |
| JP | 2005 533678 | A | 11/2005 |
| RU | 2232078 | C2 | 7/2004 |
| WO | WO 2004/009360 | A | 1/2004 |

OTHER PUBLICATIONS

German Office Action DE 10 2007 050 490.1.
Russian Decision of Grant 2010107613/12(010690) and German translation thereof.

* cited by examiner

DEVICE AND METHOD FOR ADDING INFORMATION ON THE OUTER SURFACE OF ARTICLES, SUCH AS CONTAINERS IN A CONTAINER FILLING PLANT

CONTINUING APPLICATION DATA

This application is a Continuation application of U.S. patent application Ser. No. 12/698,638, filed on Feb. 2, 2010, which is a Continuation-In-Part application of International Patent Application No. PCT/EP2008/005711, filed on Jul. 12, 2008, which claims priority from Federal Republic of Germany Patent Application No. 10 2007 036 752.1, filed on Aug. 3, 2007, Federal Republic of Germany Patent Application No. 10 2007 050 490.1, filed on Oct. 19, 2007, and Federal Republic of Germany Patent Application No. 10 2007 050 493.6, filed on Oct. 19, 2007. International Patent Application No. PCT/EP2008/005711 was pending as of the filing date of U.S. patent application Ser. No. 12/698,638. U.S. patent application Ser. No. 12/698,638 was pending as of the filing date of this application. The United States was an elected state in International Patent Application No. PCT/EP2008/005711.

BACKGROUND

1. Technical Field

The present application relates to a device and method for adding information on the outer surface of articles, such as containers in a container filling plant.

2. Background Information

Background information is for informational purposes only and does not necessarily admit that subsequently mentioned information and publications are prior art.

A beverage bottling plant for filling bottles with a liquid beverage filling material can possibly comprise a beverage filling machine, which is often a rotary filling machine, with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material.

A wide variety of types of filling elements are used in filling machines in beverage bottling or container filling plants for dispensing a liquid product into bottles, cans or similar containers, including but not limited to filling processes that are carried out under counterpressure for the bottling of carbonated beverages. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine.

After a filling process has been completed, the filled beverage bottles are transported or conveyed to a closing machine, which is often a rotary closing machine. A revolving or rotary machine comprises a rotor, which revolves around a central, vertical machine axis. There may further be provided a conveyer arrangement configured to transfer filled bottles from the filling machine to the closing station. A transporting or conveying arrangement can utilize transport star wheels as well as linear conveyors. A closing machine closes bottles by applying a closure, such as a screw-top cap or a bottle cork, to a corresponding bottle mouth. Closed bottles are then usually conveyed to an information adding arrangement, wherein information, such as a product name or a manufacturer's information or logo, is applied to a bottle. A closing station and information adding arrangement may be connected by a corresponding conveyer arrangement. Bottles are then sorted and packaged for shipment out of the plant.

Many beverage bottling plants may also possibly comprise a rinsing arrangement or rinsing station to which new, non-return and/or even return bottles are fed, prior to being filled, by a conveyer arrangement, which can be a linear conveyor or a combination of a linear conveyor and a starwheel. Downstream of the rinsing arrangement or rinsing station, in the direction of travel, rinsed bottles are then transported to the beverage filling machine by a second conveyer arrangement that is formed, for example, by one or more starwheels that introduce bottles into the beverage filling machine.

It is a further possibility that a beverage bottling plant for filling bottles with a liquid beverage filling material can be controlled by a central control arrangement, which could be, for example, a computerized control system that monitors and controls the operation of the various stations and mechanisms of the beverage bottling plant.

In some beverage bottling plants, an information adding station comprises devices or machines that work in clocked cycles for the direct imprinting of containers, in particular in the form of glass or plastic bottles, for example to apply information and/or advertising so that it is permanent and cannot be detached from the container. The information adding is generally done either using a screen-printing process or by pad printing.

Containers in terms of the present application are, in at least one possible embodiment, packaging means, in the form of containers, for the most varied types of liquid products and in this case, in at least one possible embodiment of the present application, also bottles or bottle-type containers or cans or can-like containers. Printing inks in terms of the present application are those colors or inks, in at least one possible embodiment, in lightly viscous liquid form that can be processed with print heads that are digitally actuatable and operate according to the ink jet print head principle.

Consequently, print heads in terms of the present application are, in at least one possible embodiment, print heads that have a plurality of print nozzles for discharging the printing ink, for example in at least one row, and that are individually actuatable for discharging the printing ink and, for this purpose, have a print generating element at the respective nozzle opening, for example in the form of an electrode of a piezo element.

Devices for printing containers by using print heads that operate according to the ink jet print head principle and with relative movement between the print heads and the respective containers are known. In the case of a some existing devices, during the printing process the containers are each positioned on a mandrel in the form of a container support. A plurality of print heads are provided distributed about the mandrel, with which print heads, when the mandrel is rotated, a colored printed image, consisting of a plurality of color sets, is applied to the respective container. The mandrels are provided on a rotatably driven transport element, with which, during the printing, the containers are moved on a transport section formed between a container inlet and a container outlet.

OBJECT OR OBJECTS

An object of at least one possible embodiment of the present application is to provide a device with which, at high output, it is possible to print containers with a high-quality print formed by at least one printed image.

SUMMARY

At least one possible embodiment of the present application teaches a device for printing containers in multiple colors on at least one outer surface of the container. In at least one possible embodiment of the present application, the device includes a print that is formed by at least one printed image. At least one possible embodiment of the present application has at least one printing group with at least two print heads that operate according to the ink jet print head principle for generating part printed images of the printed image that is to be applied to the outer surface of the container in at least one printing step. At least one possible embodiment of the present application includes a transport element to move the containers in a direction of transport during the printing, wherein the printing groups or their print heads are moved, at least during part of the at least one printing step, by the transport element. In at least one possible embodiment of the present application, print heads are switchable on and switchable off for a print head change or part print change in such a manner that a print head situated in a printing position at the relevant container is movable out of the printing position and another print head is movable into the printing position.

Another possible embodiment of the present application teaches a device for printing containers in multiple colors by means of a transfer print. At least one possible embodiment of the present application includes a device which has at least one printing group with at least two print heads that operate according to the ink jet print head principle for generating printed images, each comprising at least two part printed images, onto transfer pads which are moved past the printing group. In at least one possible embodiment of the present application, the printed images are transferred onto the containers by rolling off the respective containers at a transfer region, and a container conveyor moves the containers in a direction of transport during the printing. At least one possible embodiment of the present application has an auxiliary conveyor with a plurality of transfer pads that are moved with the auxiliary conveyor on a path of movement that is closed per se. In at least one possible embodiment of the present application, the container conveyor is a rotor that is rotatably driven about a vertical machine axis, and the auxiliary conveyor is a wheel-shaped or drum-shaped element that is rotatably driveable about the machine axis.

A further possible embodiment of the present application teaches a device for printing containers in multiple colors by means of a transfer print. In at least one possible embodiment of the present application, the device includes at least one printing group with at least two print heads that operate according to the ink jet print head principle for generating printed images, each comprising at least two part printed images, onto transfer surfaces of transfer pads which are moved past the printing group. In at least one possible embodiment of the present application, the printed images are transferred onto the containers by rolling off the containers at a transfer region, and a container transport element moves the containers in a direction of transport during the printing. At least one possible embodiment of the present application includes an auxiliary conveyor with a plurality of transfer pads that are moved with the auxiliary conveyor on a path of movement that is closed per se. In at least one possible embodiment of the present application, the transfer pads are provided so as to be controllable or pivotable on the auxiliary conveyor in such a manner that they are oriented with their transfer surface in a horizontal or substantially horizontal manner when passing the printing group, and they abut against the outside surface of the upright containers with their transfer surface at the printing position.

At least one possible embodiment of the present application also teaches a method for printing containers in multiple colors on their container outer surface with a print that is formed by at least one printed image. At least one possible embodiment of the present application uses at least one printing group, with at least two print heads, that operate according to the ink jet print head principle for generating part printed images of the printed image to be applied to the outer surface of the container in at least one printing step. In at least one possible embodiment of the present application, the containers are moved on a transport element in a direction of transport during the printing, and the printing groups are entrained with the transport element at least during part of the at least one printing step. In at least one possible embodiment of the present application, after printing a part image, and before printing another part image, a print head change is carried out in such a manner that a print head that is situated in a printing position at the relevant container is moved out of the printing position and another print head is moved into the printing position.

Another possible embodiment of the present application teaches the method wherein the print heads of the printing unit are moved in a rotating manner on a path of movement that is closed per se.

In at least one possible embodiment of the present application teaches, the transfer pads are moved on a circular path of movement within the circular path of movement of the containers.

In at least one possible embodiment of the present application, the containers are printed on their outside surfaces by applying the printing ink with the print heads directly onto the outer surface of the container or with a transfer print method by using transfer elements or transfer pads onto which the respective printed image is applied with the print heads and is then transferred onto the containers.

Further developments, advantages and application possibilities of various embodiment examples of the present application are produced from the following description of possible embodiments and from the Figures. In this case, all or virtually all described and all or virtually all graphically represented features, individually on their own or in arbitrary combination, are in principle objects of at least one possible embodiment of the present application.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

At least one possible embodiment of the present application is described in more detail below by way of the Figures of examples of devices for printing containers in multiple colors on an outer surface of the container that is realized in a rotationally-symmetrical manner about a container axis, for example on an outer surface of a container that is cone-like or in the shape of a circular cylinder, in which, in detail.

DESCRIPTION OF EMBODIMENT OR EMBODIMENTS

Figure 1:
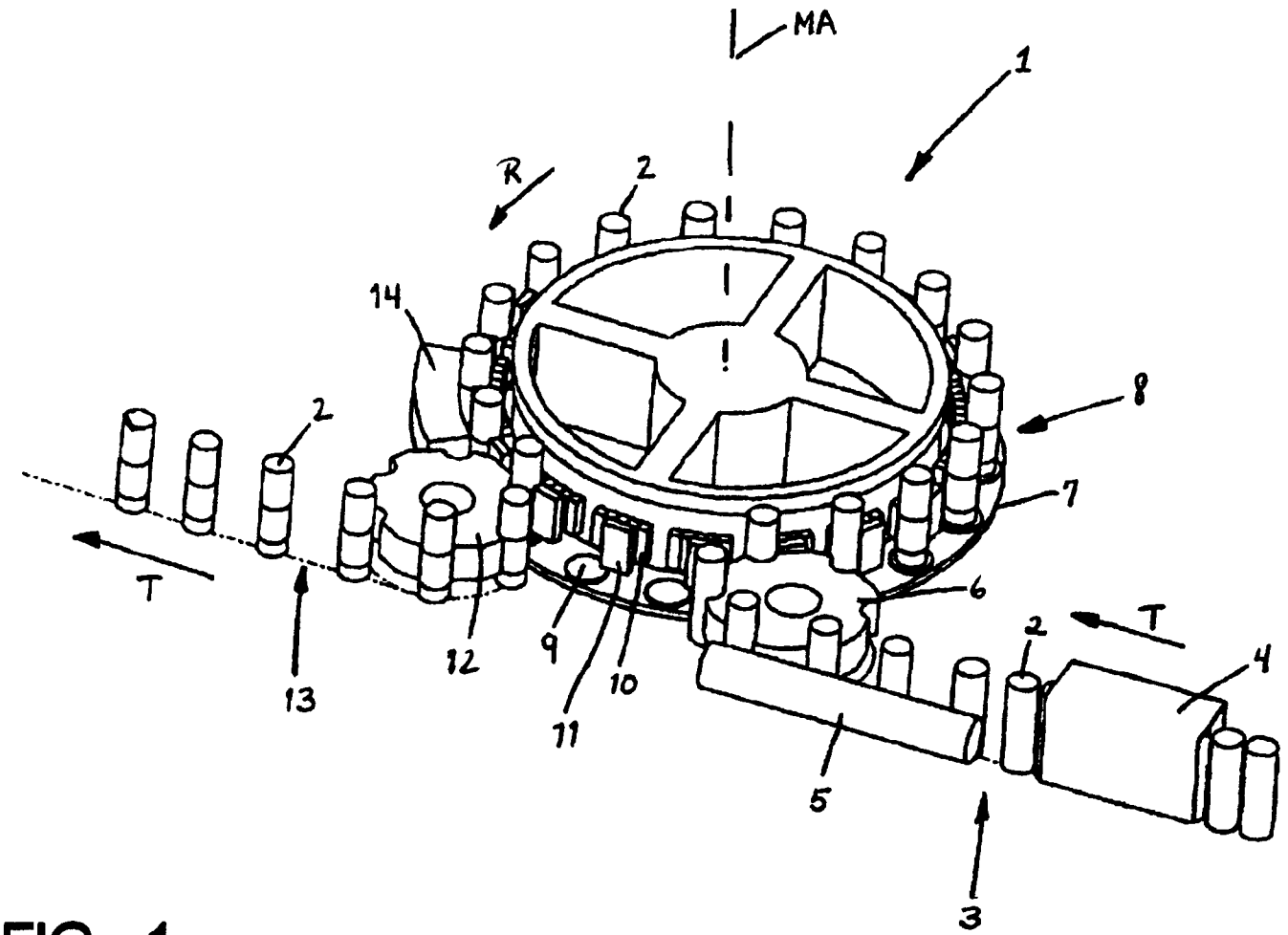
FIGS. 1 and 2 show a schematic, perspective representation and a top view of the device according to at least one possible embodiment of the present application.
Figure 2:
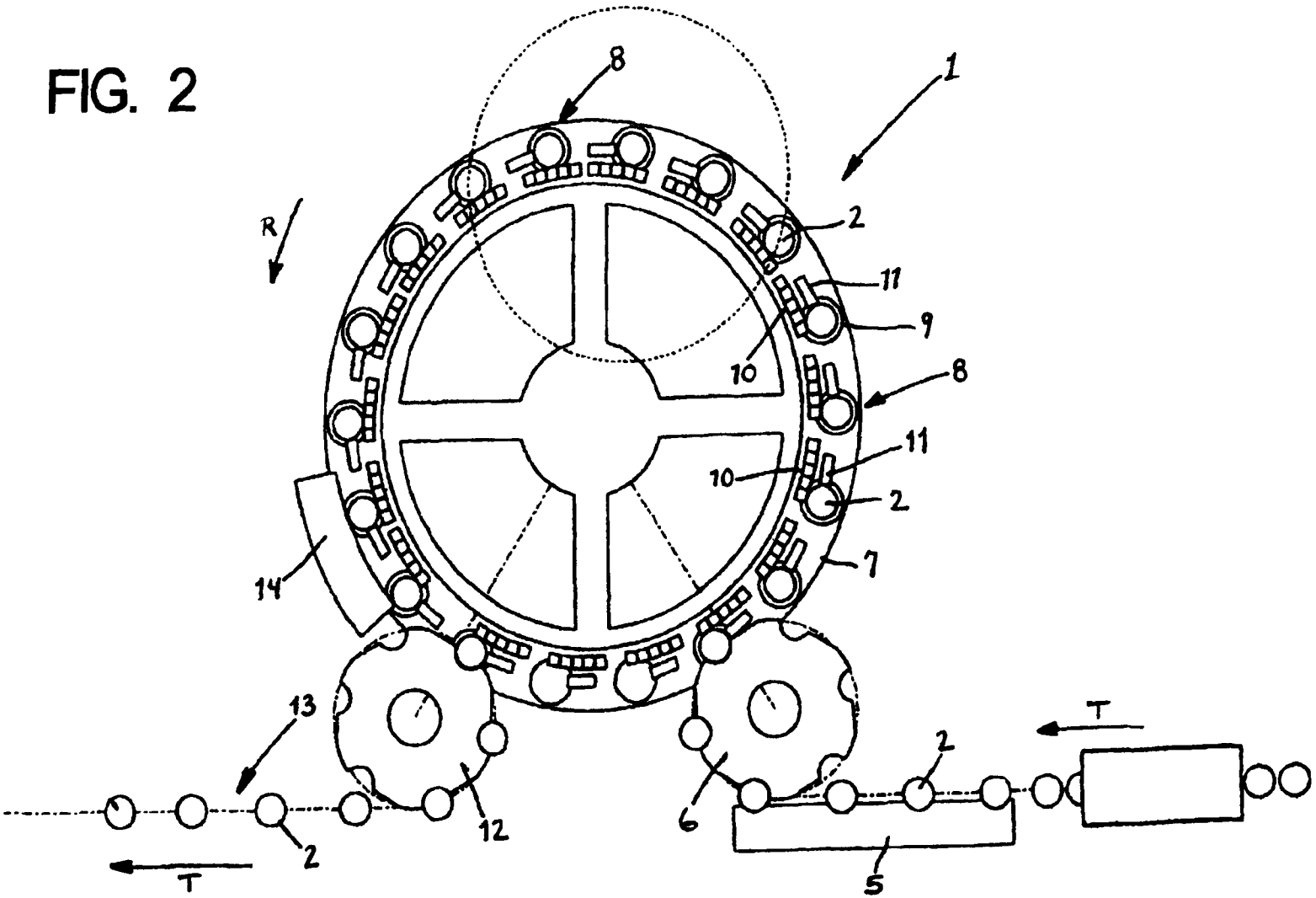
Figure 3:
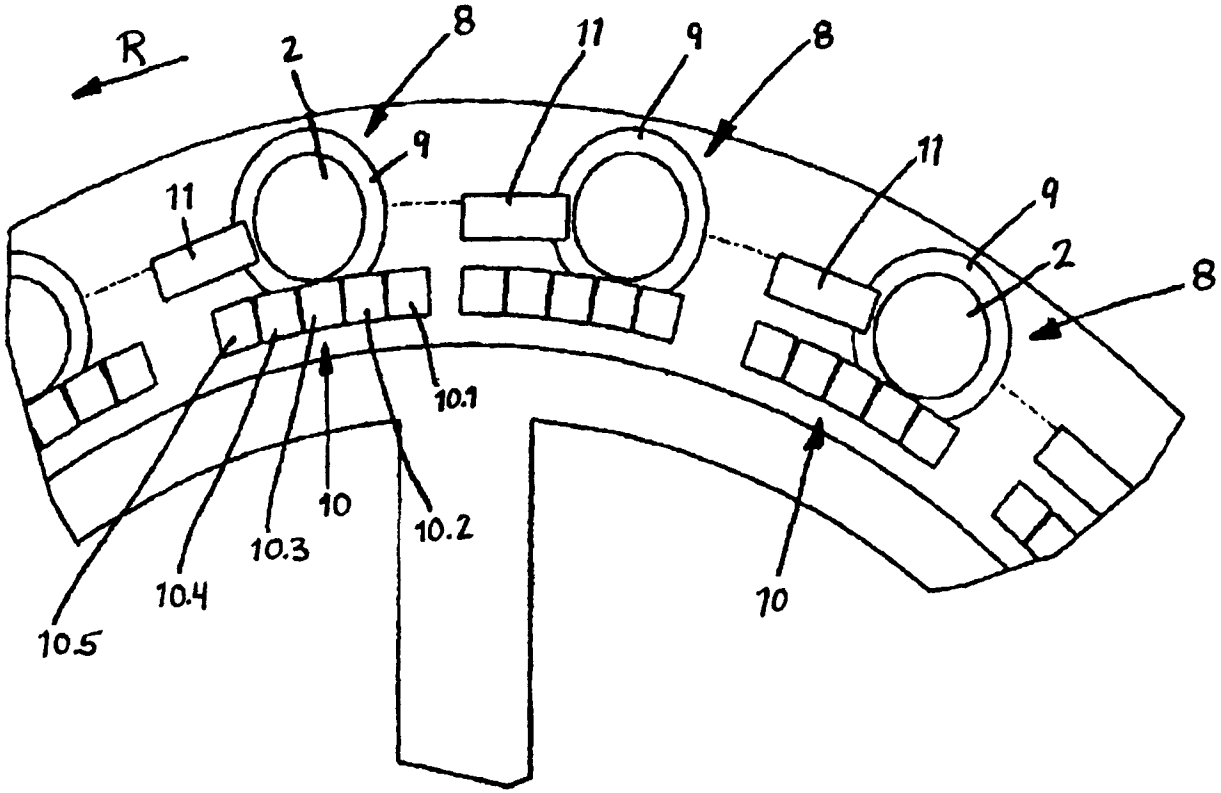
FIG. 3 shows a partial representation of a top view of a rotor of the device in FIGS. 1 and 2, said rotor being rotatably driveable about a vertical machine axis.

In FIGS. 1-3 the reference 1 is given to a device for printing containers 2 in multiple colors on their outer or outside surface and, in this case, in at least one possible embodiment, on a region of the container outside surface that is realized in a rotationally-symmetrical manner with reference to the container axis, for example on a circular cylindrically shaped or frustum-shaped or substantially circular cylindrically shaped or frustum-shaped region of the outer surface of the container.

The containers 2 are supplied to the device 1 by means of a conveyor, identified schematically in the Figures by the reference 3, standing upright, i.e. oriented with their container axes in the vertical or substantially vertical direction and in a single-track container flow in the direction of transport indicated by the arrow T and after they pass a corona tunnel 4 and a separating screw 5 they reach a rotor 7 of the device 1. At the periphery of the rotor 7, which is rotatably driveable about a vertical machine axis MA in the direction of the arrow R, printing stations 8 are formed at regular angular spacings offset about said machine axis, said printing stations comprising in each case substantially a container support 9, in the form of a turntable that is rotatable in a controlled manner about an axis parallel or substantially parallel to the machine axis, a printing group 10 and a device 11 for drying and/or setting the printing ink. Each printing group 10, in the possible embodiment represented, includes four print heads 10.1-10.4 for generating various color sets of a multiple color print or printed image and another print head 10.5 for flat printing or applying a transparent sealing or protective coating, for example a covering finish onto the printed image generated with the print heads 10.1-10.4.

The print heads 10.1-10.4 are digitally actuatable print heads of the ink jet print head type, for example print heads that can be obtained commercially under the reference "XAAR" or "Xaar500." The print heads 10.1-10.5 each comprise, correspondingly, a housing with a plurality of individually actuatable print nozzles for discharging the printing ink in the distribution and quantity corresponding to the respective printed image or color set on the background to be printed on, i.e. in the present case onto the outer surface of the container to be printed on. The print nozzles, oriented with their axes horizontally or substantially horizontally, are positioned on each print head 10.2-10.5 in at least one row parallel or substantially parallel to the vertical machine axis MA. The discharging of the printing ink is achieved, for example, through corresponding actuation of electrodes or of piezo elements in the print heads 10.1-10.5, for example at an actuating frequency of up to fifty kiloHertz and a relative movement between the respective print head and the surface to be printed of five hundred sixty millimeters per second. The number of print nozzles per print head is, for example, in the range of 500 with a print width of approximately seventy millimeters. The print heads 10.1-10.4 include color printing ink in different colors, namely in yellow, magenta, cyan and black.

As shown in FIGS. 1-3, the print heads 10.1-10.5 of all the printing stations 8 are positioned on a common circular line surrounding the machine axis MA in such a manner that the print heads of all or essentially all the printing groups 10 entrained with the rotating rotor 7 are situated, with reference to the machine axis MA, inside a circular path on which the container supports 9 move. The print nozzles of all or essentially all the print heads 10.1-10.5, consequently, with reference to the machine axis MA, are aligned with their axes constantly or virtually constantly radially outwards such that the discharging of the printing ink onto the containers 2 is supported by the centrifugal force when the rotor 7 is rotating.

The printing group 10 of each printing station 8, as detailed, is realized in a rotating manner with the rotor 7, however, for the print head change, is at the same time pivotable about the machine axis MA in a successive manner or is switchable further in the direction of rotation of the rotor and in opposition to said direction of rotation such that when a container 2 is being printed, each print head 10.1-10.5 can be moved at least once into a printing position in which the relevant print head with its print nozzles is directly adjacent the container 2 standing upright on the container support 9 with a small distance in between (e.g. less than one millimeter). The device 11, which performs the drying of the printing ink through an application of energy or heat and/or UV radiation, is provided about the axis of the respective container support 9 offset by approximately ninety degrees relative to the printing group 10. With the device 1, the devices 11 are positioned on a common circular line surrounding the machine axis MA, the radius of said circular line being identical or substantially identical to the distance between the axes of the container supports 9 and said machine axis MA, in such a manner that in the direction of rotation R of the rotor the respective device 11 is ahead of the associated container support 9.

For the printing, the containers 2 are transferred in each case individually via the transport star 6 to a printing station 8, at which, with a controlled rotational movement of the container support 9 and consequently with a controlled rotational movement of the containers 2 about their container axes, one after the other the color sets forming the color print are printed with the print heads 10.1-10.4 and then the protective coating is applied with the print head 10.5.

In detail, the printing of each container is effected such that, after the transfer to a printing station 8, the color set corresponding to the print head or the final protective coating are printed onto the outer surface of the container with the print heads 10.1-10.5 each switched into the printing position, and during the printing of each color set and possibly also even during the switching further of the printing group 10 by a print head spacing or by a print head, the drying of the applied printing ink is performed by means of the device 11. During each printing step, i.e. during the printing of the respective color set or the applying of the protective coating and the drying of the printing ink or of the protective coating, each container 2 is rotated by three hundred sixty degrees. Each printing step with the drying is effected for example on an angular region of the rotational movement of the rotor 7 of about fifty degrees such that the printing of the containers 2 is completed reliably before the containers 2 reach a container outlet at which they are discharged via a transport star 12 on a conveyor 13. The resetting of the printing groups 10 into the initial position is effected in the angular region of the rotational movement of the rotor 7 between the transport stars 12 and 6. An improved or sharper printed image is achieved through the treatment in the corona tunnel by charging the containers 2 electrostatically on their outer surface.

An optoelectric control system 14 is provided in the direction of rotation R of the rotor directly before the transport star 12, by means of which control system the print on the containers 2, which are moved past said system and are rotated further about the container axis, is checked so that containers with a faulty print can be discharged on the conveyor 13.

Figure 4:
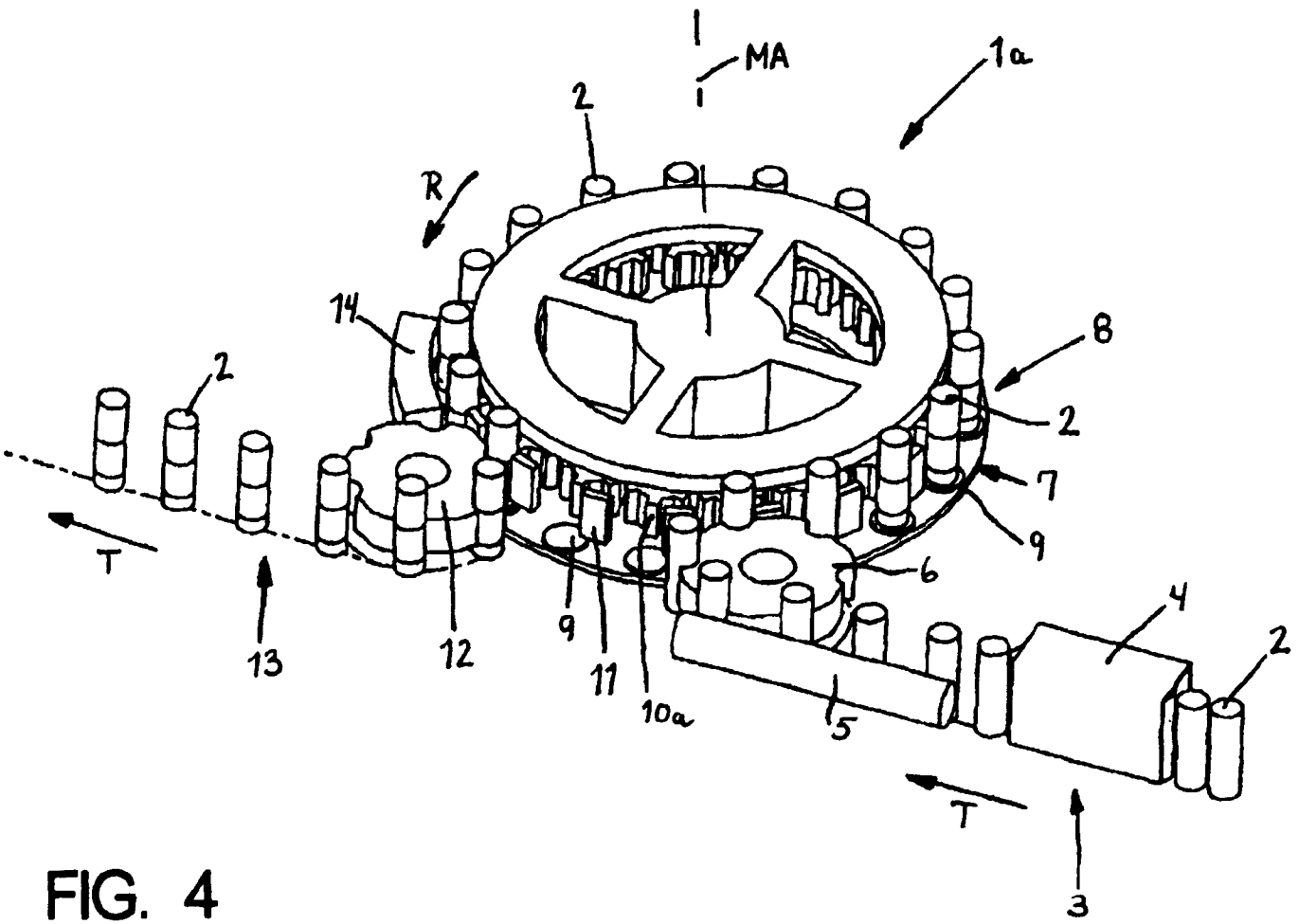
FIGS. 4-6 show representations as in FIGS. 1-3 of an additional possible embodiment of the present application.
Figure 5:
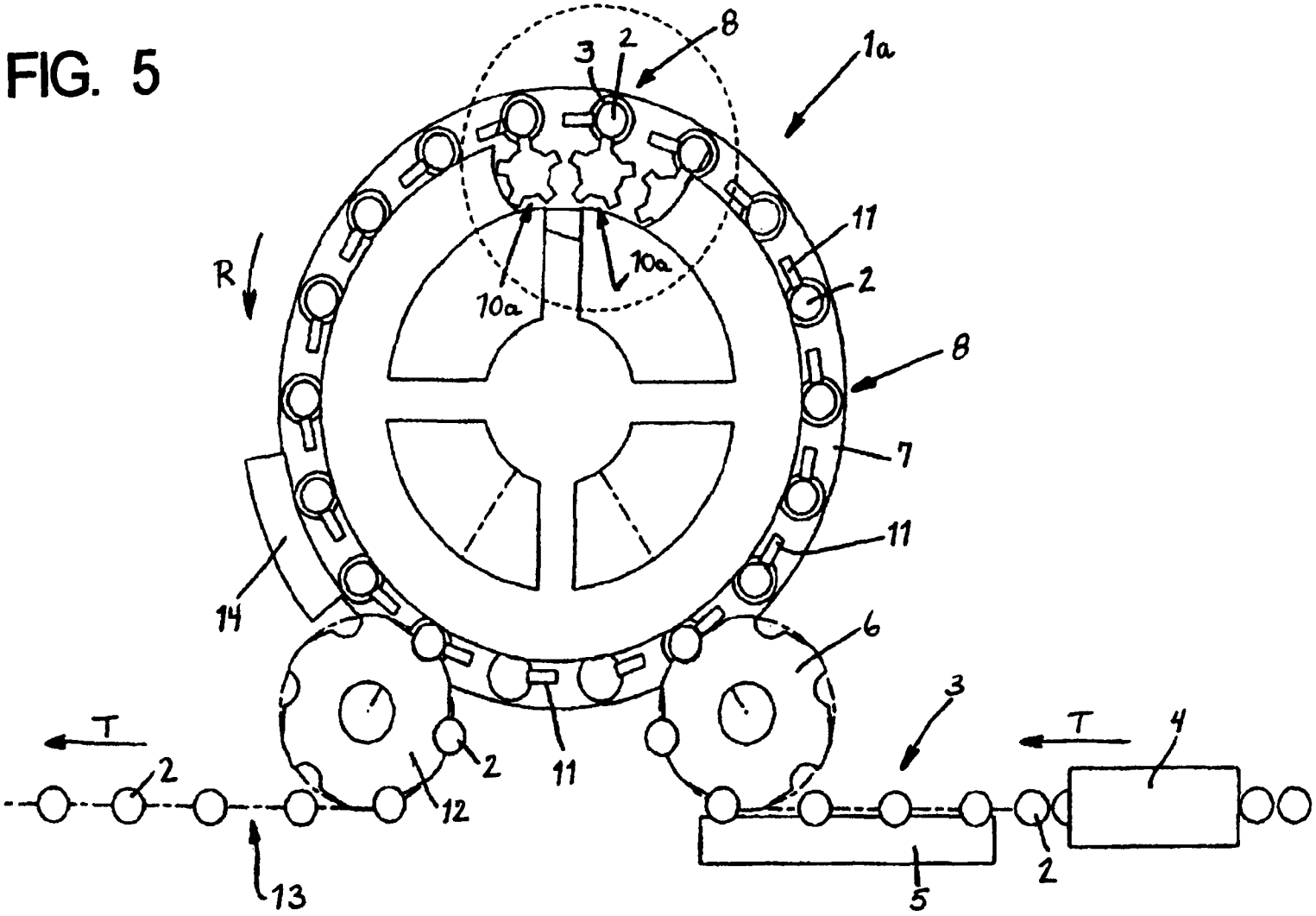
Figure 6:
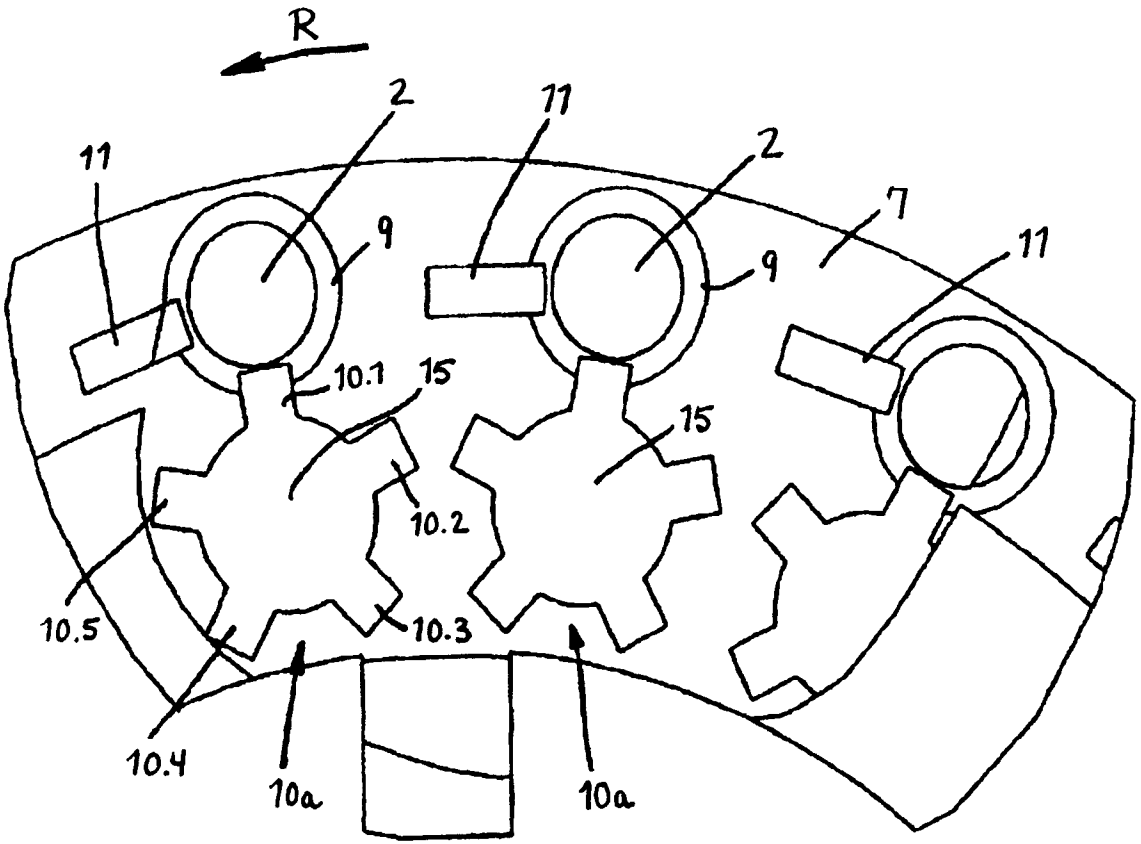

FIGS. 4-6 show, in the form of another specific embodiment, a device 1*a* which only or virtually only differs substantially from the device 1 in that at the individual printing stations 8 instead of the printing groups 10, printing groups 10*a* are provided that have the print heads 10.1-10.5 at a support 15, which can be switched further for the print head change by rotating about an axis parallel or substantially parallel to the machine axis MA. The print heads 10.1-10.5 are provided distributed at regular angular distances on the periphery of the support 15. The supports 15 are situated, in their turn, inside the path of movement of the container supports 9 such that each print head moved into the printing position, i.e. positioned directly adjacent the container 2 to be printed, is aligned with its print nozzles radially outwards with reference to the machine axis MA. The printing of the containers 2 is effected, in the case of the device 1*a*, once again onto the angular region of the rotational movement of the rotor 7 between the transport star 6 and the control system 14, the corresponding print head being switched into the printing position for each color set and for the sealing or protective coating. The printing ink or the sealing or protective coating is dried by means of the device 11 during the printing. The respective container 2 is rotated by three hundred sixty degrees during the printing steps (applying the color sets, the sealing or protective coating and the drying).

Figure 7:
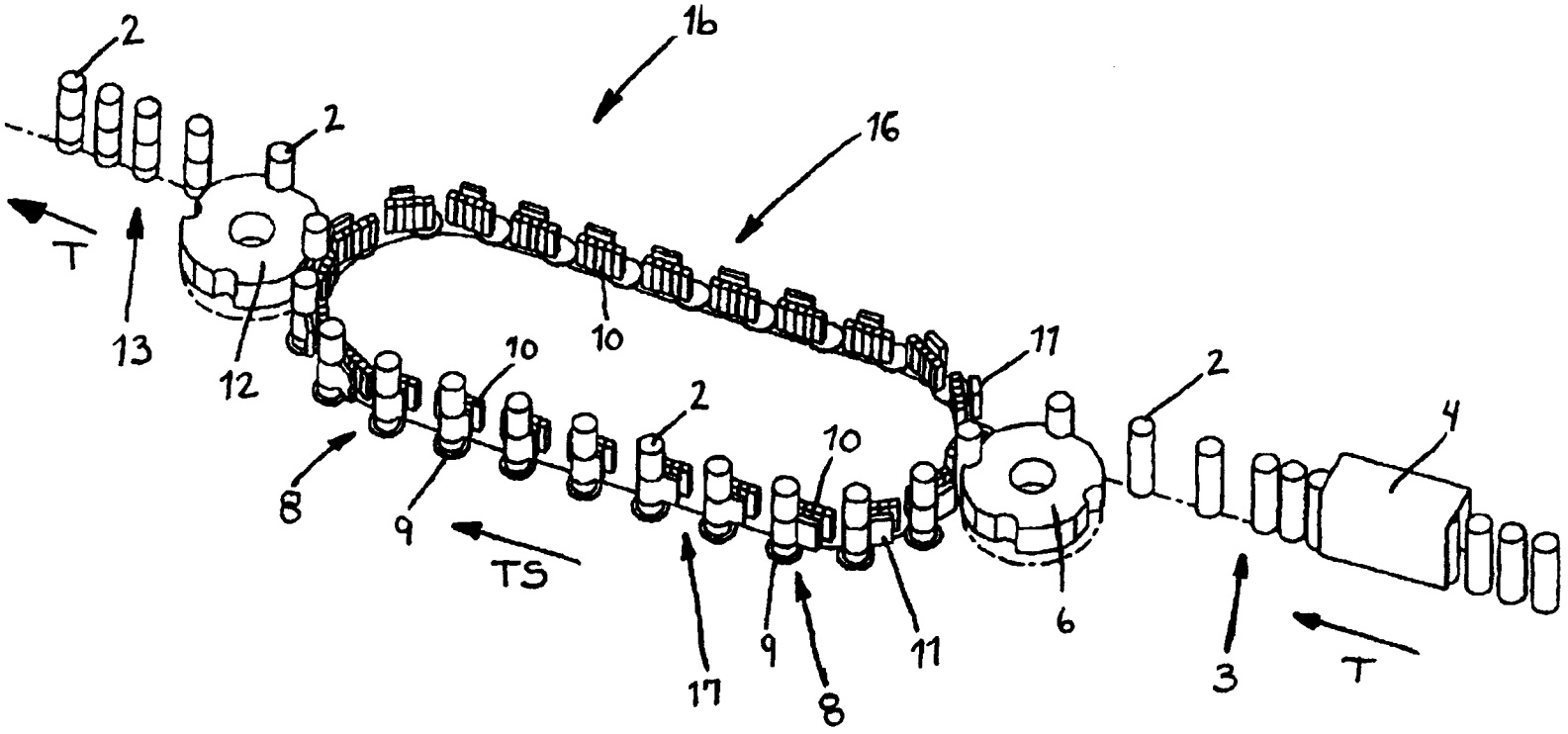
FIGS. 7 and 8 show a schematic, perspective representation and top view of another possible embodiment of the device according to the present application.
Figure 8:
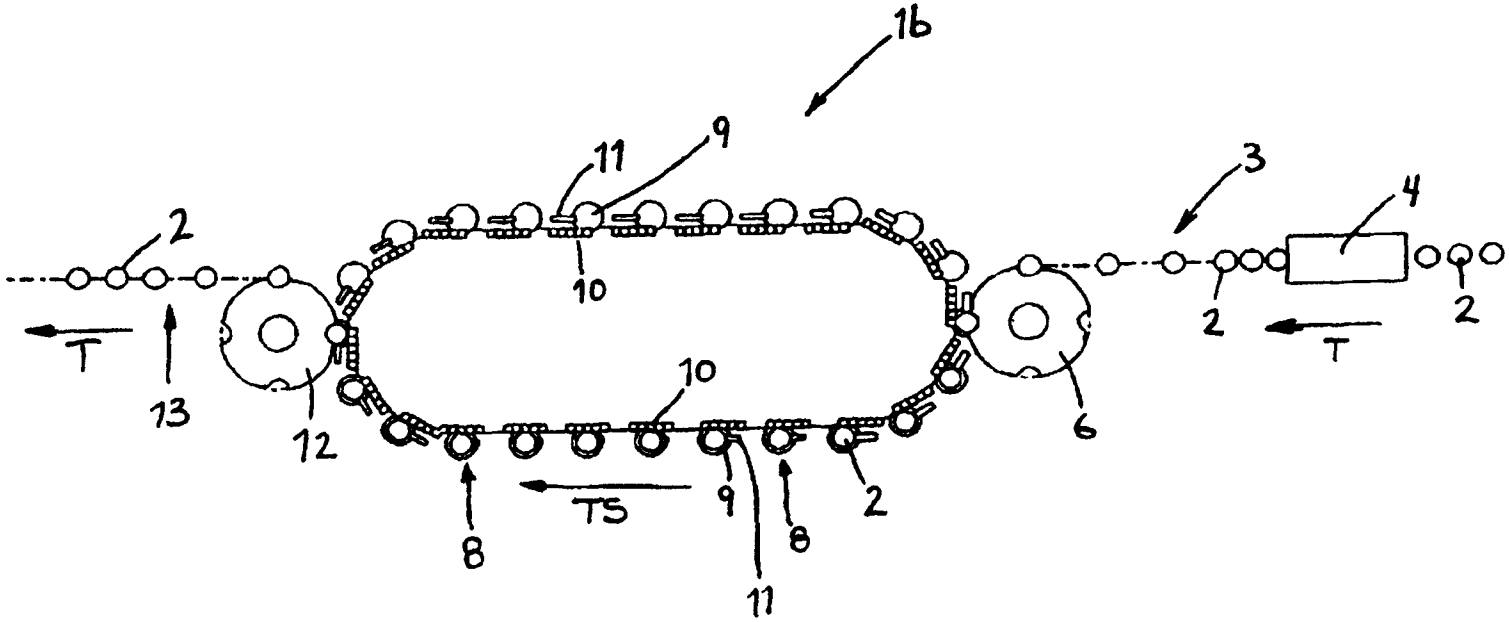
Figure 9:
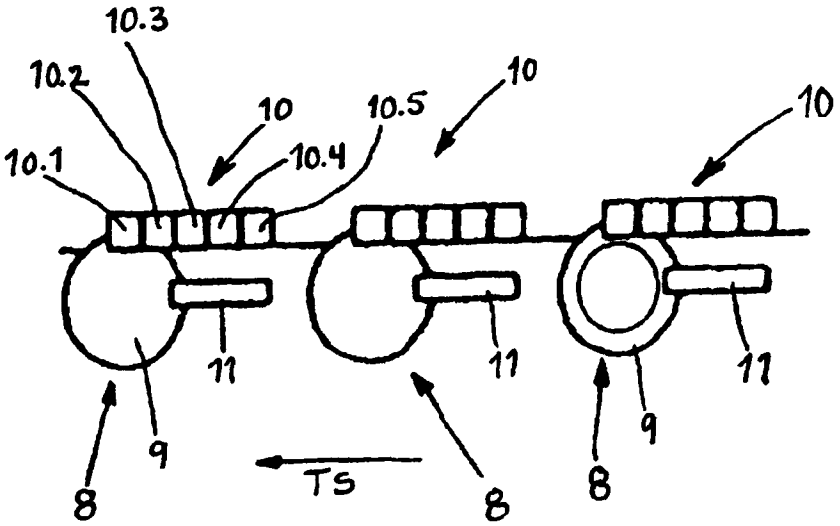
FIG. 9 shows a top view of a part representation of the transport system of the device in FIGS. 7 and 8 with the printing groups.
Figure 10:
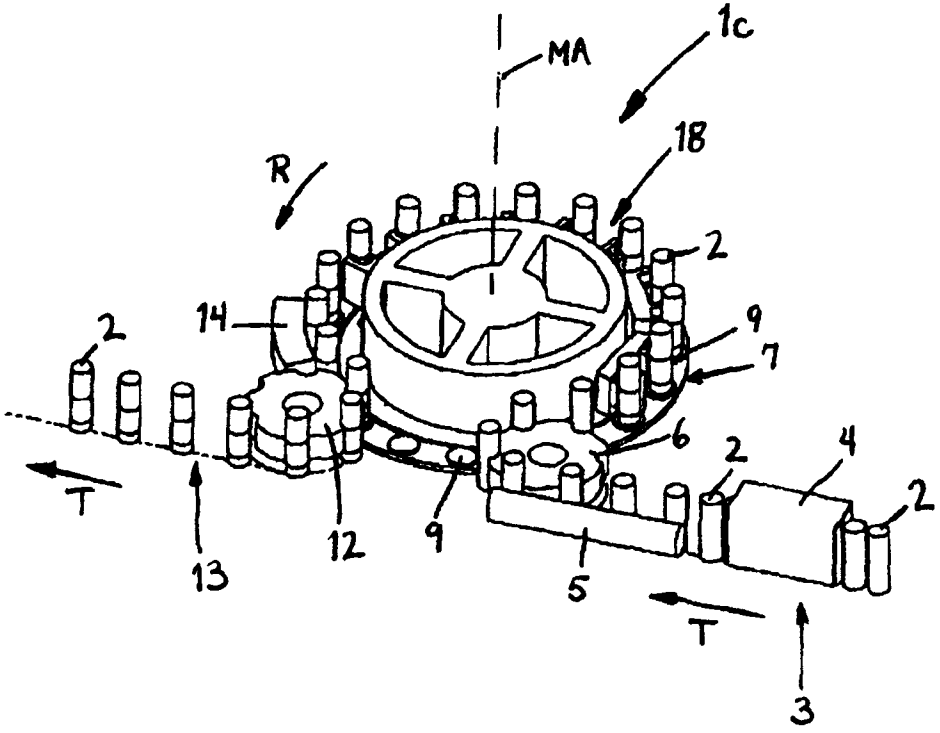
FIGS. 10 and 11 show a schematic, perspective representation and top view of another possible embodiment of the device according to the present application.
Figure 11:
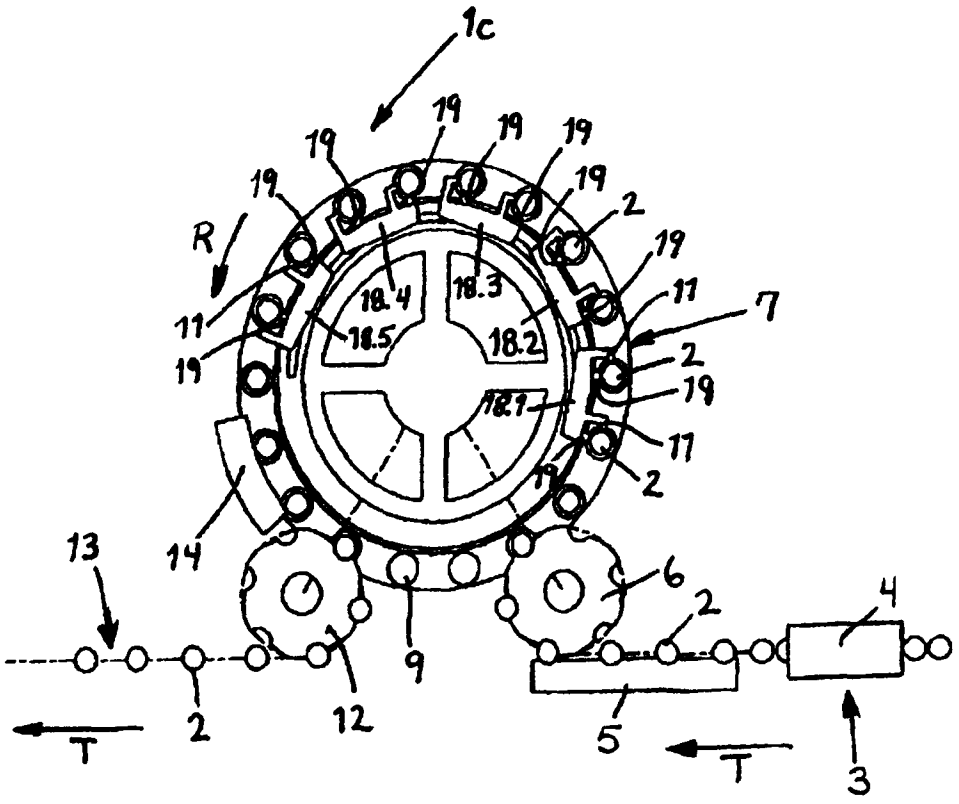
Figure 12B:
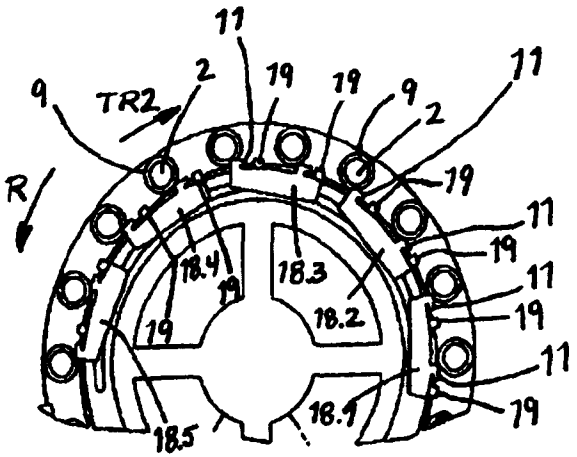
FIGS. 12A, 12B, and 12C show a part representation and top view of the rotor, in different positions, together with a printing unit that includes a plurality of print head elements in different operating states, said rotor being rotatably driveable about the vertical machine axis.
Figure 12A:
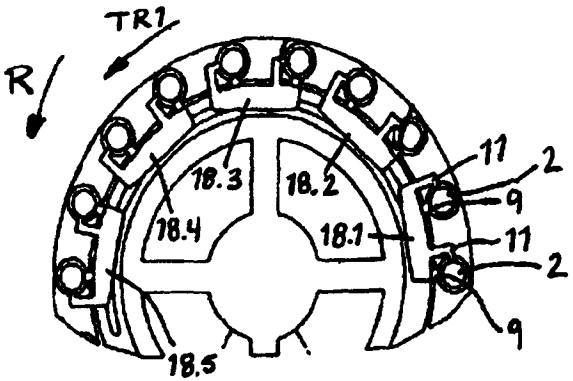
Figure 12C:
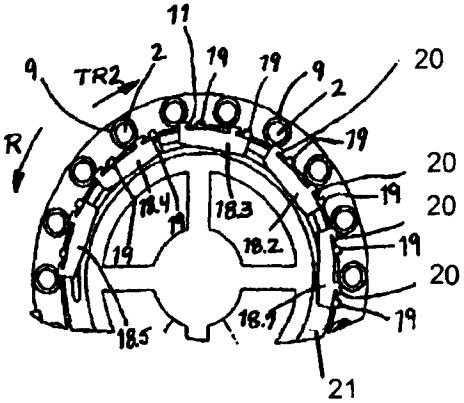
Figure 13:
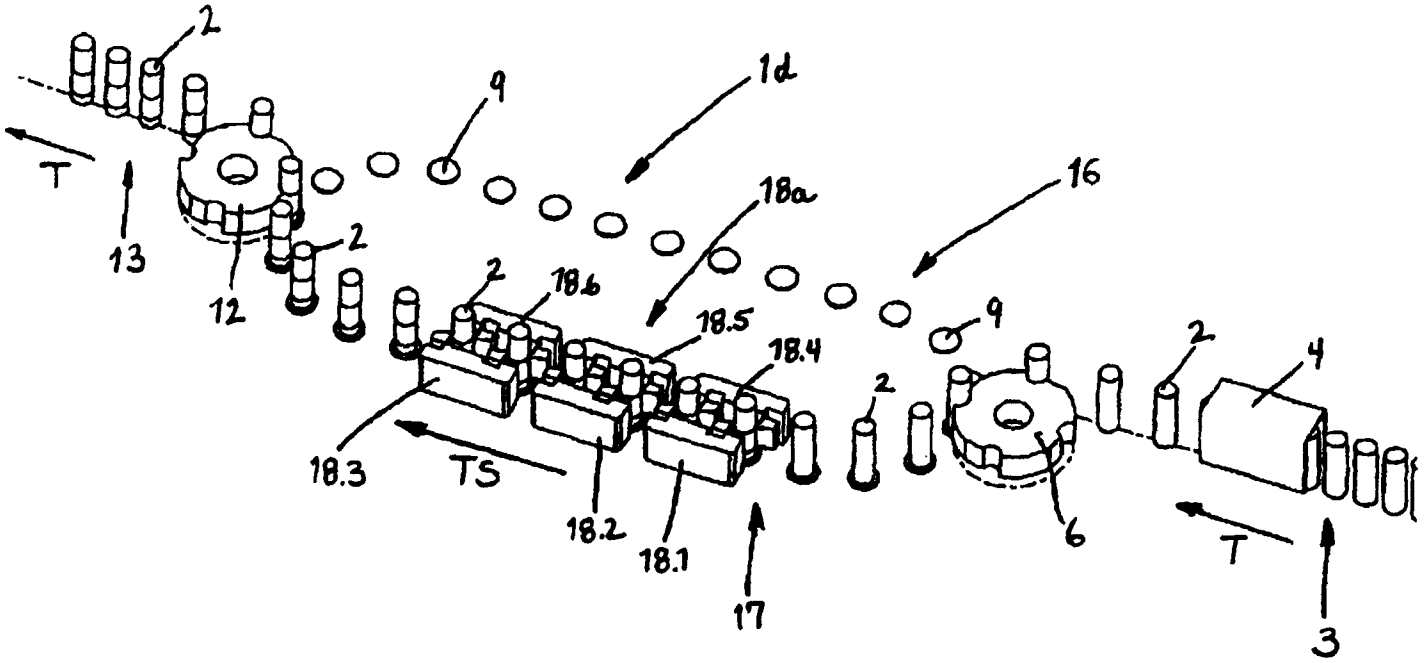
FIGS. 13 and 14 show a schematic, perspective representation and top view of another possible embodiment of the device according to the present application.
Figure 14:
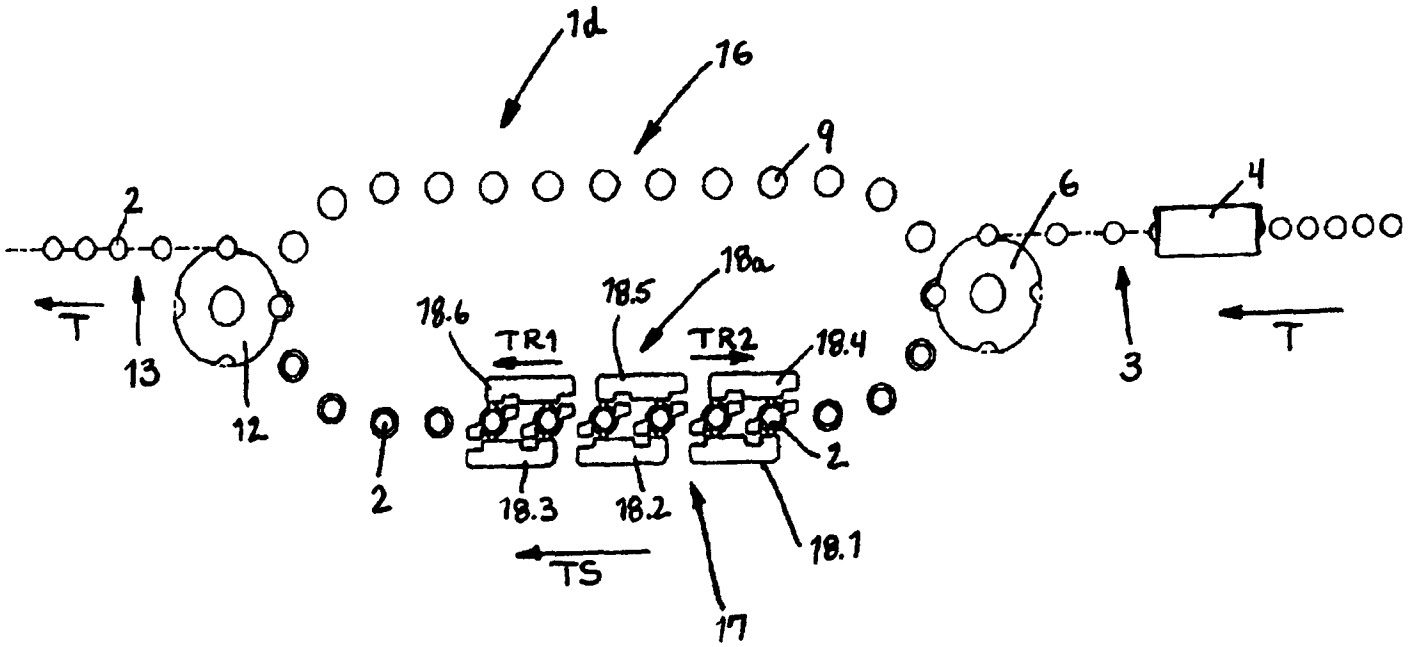
Figure 15A:
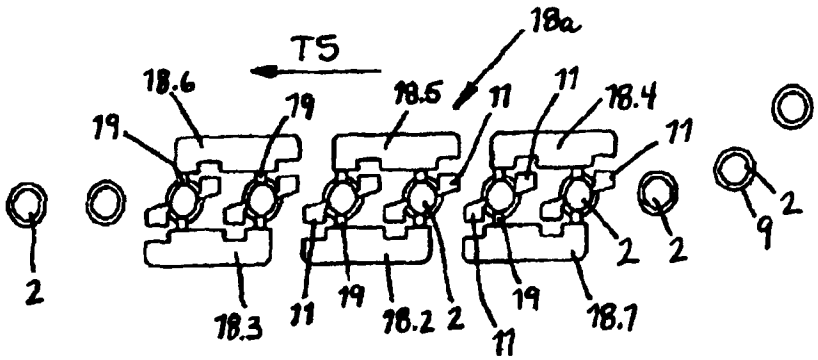
FIGS. 15A and 15B show a part representation of the conveyor in FIGS. 13 and 14, in different positions, together with a printing unit that includes a plurality of print head elements in various operating states.
Figure 15B:
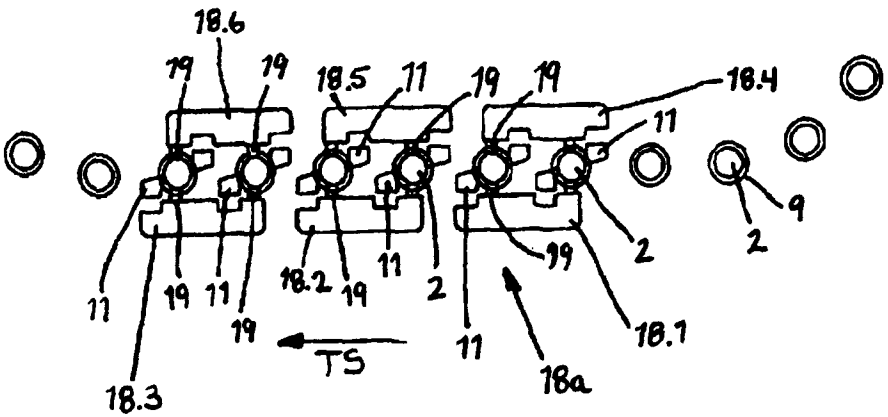

FIGS. 7 and 8 show, in the form of another embodiment, a device 1*b* which only or essentially only differs substantially from the device 1 in that instead of the rotor 7, there is provided a transport system 16, which on at least one transport element, which forms a closed loop and is driveable in an endlessly or virtually endlessly circulating manner, has a plurality of printing stations 8 at regular spacings, each with a container support 9, a printing group 10 and a device for drying the printing ink.

The containers 2 are supplied to the device 1*a* once again via the transport star 3 with the corona tunnel 4 and are transferred in each case individually via the transport start 6 to a printing station 8, with which the respective container 2 is then moved during the printing in the direction of transport TS on the transport section 17 of the transport system 16. The printed containers 2 are forwarded to the conveyor 13 with the transport star 12 that forms a container outlet.

The printing of the containers 2 with the individual printing inks or color sets of the multi-colored print and the applying of the sealing or protective coating is effected analogously to the description given in conjunction with the device 1. For this purpose, the printing groups 10, entrained with the transport system 16 or their print heads 10.1-10.5 are moveable or switchable for the print head change relative to the transport system 16 in the direction of transport TS and in opposition to said direction of transport and are situated on the inside of the loop formed by the transport system 16. The devices 11 of all or essentially all the printing stations 8 are positioned on a common loop line which also intersects the vertical axes of rotation of the container supports 9, the container supports 9 being ahead of the associated device 11 in each case in the direction of transport TS.

In detail, the printing of the containers 2 is effected once again in such a manner that by switching further the print heads 10.1-10.5, the respective color set or the sealing or protective coating are applied, and during the printing process, possibly also still during the switching further of the print heads, the drying of the printing ink and the sealing or protective coating is effected by means of the associated device 11, the respective container with the container support 9 being rotated by three hundred sixty degrees.

FIGS. 10, 11, 12A, 12B, and 12C also show, in the form of another possible embodiment of the present application, a device 1*c* for printing containers 2 in multiple colors. The device 1*c* differs from the device 1 in that a plurality of container supports 9 is provided on the periphery of the rotor 7 at regular angular spacings about the vertical machine axis MA, however, said container supports 9 are not components of the printing stations each with independent printing groups.

In the case of the device 1*c*, one single printing group or unit 18 is in fact provided with a plurality of print head units 18.1-18.5, each unit of which having a plurality of print heads 19, in the possible embodiment represented two print heads in each case. The print heads 19 are realized in the same manner as the print heads 10.1-10.5. Each print head unit 18.1-18.5 or its print heads 19 serve in the manner described in more detail below for simultaneously or substantially simultaneously discharging the color sets of a color associated with the respective print head unit or the sealing or protective coating onto a number of containers 2 corresponding to the number of print heads 19, i.e. in the case of the possible embodiment represented for simultaneously or substantially simultaneously discharging onto two containers 2.

The print head units 18.1-18.5 are also each realized with two devices 20 that can be switched on or off for drying the respective print or the printing ink, for example by the application of energy, e.g. by heating and/or UV light, in each case one device 20 being associated with one print head 19. The print head units 18.1-18.5 with their print heads 19 and their devices 20 are positioned on a common support 21, which can be moved or pivoted back and forth about the machine axis MA by a stroke that corresponds to a machine spacing, as is indicated in one possible embodiment of the present application in FIGS. 12A, 12B, and 12C with the arrows TR1 and TR2. The print unit 18 formed by the print head units 18.1-18.5 and the support 21 is therefore floating. It is situated, with reference to the machine axis MA, inside the path of movement on which the container supports 9 move when the rotor 7 rotates. In addition, the individual print heads 19 are positioned such that they point radially outwards with their print nozzles, each positioned in a row parallel or substantially parallel to the machine axis MA, with reference to said machine axis, such that the discharging of the printing ink is once again supported by the centrifugal force when the rotor 7 is rotating.

The arrangement is also such that the spacing between the print heads 19 on each print head unit 18.1-18.5, but also the spacing between adjacent print heads 19 on print head units 18.1-18.5 following one another in the circumferential direction of the rotor 7 is identical or substantially identical to the angular spacing between two adjacent container supports 9. In addition, the devices 20 in the activated or switched-on state, seen in a top view of the rotor 7, are offset by ninety degrees relative to the print heads and are positioned on a circular line that surrounds the machine axis MA and also intersects the axes of rotation of the container supports in the direction of rotation R of the rotor ahead of the adjacent container support or the container 2 standing upright on said container support in each case. Each print head unit 18.1-18.4 has associated therewith in each case a color set or a color, namely yellow, magenta, cyan or black. The print head unit 18.5 or its print heads 19 serve for discharging or printing the sealing or protective coating.

The print head units 18.1-18.5 are provided following one another in the direction of rotation R of the rotor in order of their reference numbers, i.e. in the direction of rotation R of the rotor the print head unit 18.1 forms the first print head unit of the printing unit 18 and the print head unit 18.5 forms the last print head unit of the printing unit 18.

The multi-colored printing of each container 2 is effected once again in several chronological printing steps in which the printing, i.e. discharging the relevant color set or the sealing or protective coating and the drying is effected with the containers 2 rotating about the container axes, for example rotating about three hundred sixty degrees. The individual printing steps are executed at each container chronologically one after the other by the print head units 18.1-18.5, with each print head unit 18.1-18.5 at two containers simultaneously or substantially simultaneously in each case. During each printing step, the printing unit 18 is entrained in the same direction and in a synchronous or substantially synchronous manner with the rotor 7 (arrow TR1). The devices 20, in this case, are delivered and activated so that the drying of the generated color sets is also effected during each printing step.

After the completion of each printing step and before the introduction of a new printing step, the printing unit 18 is pivoted back, with devices 20 retracted, in opposition to the direction of rotation R of the rotor by the machine spacing into the initial position (arrow TR2), in which then, on account of the rotational movement of the rotor 7, an unprinted container 2 in each case is adjacent the print heads 19 of the print head unit 18.1 and a container 2 in each case that has already been printed in a previous printing step by the print heads 18.1-18.4 is adjacent the print heads 19 of the print head units 18.2-18.5 for another printing step. In the next printing step, the floating printing unit 18 is then entrained again in the same direction and in a synchronous or substantially synchronous manner with the rotational movement of the rotor 7 by the machine spacing (arrow TR1) and after completion of this printing step is pivoted back by the machine spacing into the original position (arrow TR2). The machine spacing, in this case, is twice the spacing between two container supports 9.

The printing of the containers 2 in multiple colors is completed before said containers 2 reach the transport star 12 that forms the container outlet, so that, also in the case of the device 1*c*, a control system 14, for example an optoelectric control system is provided in the direction of rotation R of the rotor before the transport star 12 for checking the respective print on the containers 2 moved past said system and being rotated at the same time so that containers 2 with missing or faulty print can subsequently be discharged onto the conveyor 13.

FIGS. 13, 14, 15A and 15B show, in the form of another embodiment, a device 1*d* which differs in the first instance from the device 1*c* in that instead of the rotor 7 a transport system 16 is provided that forms a closed loop and is driven in an endlessly circulating manner. The container supports 9 are provided on said transport system 16. In addition, at the transport section 17 of the transport system 16 on which the printing of the containers 2 in multiple colors is effected, there is provided a printing unit 18*a*, which comprises a plurality of print head units, namely a total of six print head units 18.1-18.6, three of which print head units 18.1-18.3 or 18.4-18.6 are positioned in each case on each side of the transport section 17. The transport system 16 has the container supports 9 at regular spacings.

The print head units 18.1-18.6 are realized in the identical manner as described for the device 1*c* for the print head units 18.1-18.5 used there, i.e. each print head unit 18.1-18.6 has two print heads 19 spaced apart by half the machine spacing and two devices 20 also spaced apart by half the machine spacing. In addition, the print heads 19 and devices 20 of print head units 18.1-18.3 or 18.4-18.6 adjacent one side of the transport section 17 are each spaced apart by half the machine spacing.

The printing unit 18*a* or the print head units 18.1-18.6 positioned on a support (not shown) are moveable by a drive (not shown) in a synchronous or substantially synchronous manner and in the same direction with the movement of the transport system 16 out of an initial position in the direction of transport TS by the machine spacing and in opposition to the direction of transport TS back into the initial position, said floating movement also being synchronized or substantially synchronized with the movement of the transport system 16 in such a manner that after the movement back into the initial position, each print head 19 with its printing nozzles is once again situated directly opposite or substantially opposite a container support 9 or a container 2 at that location.

The containers 2 to be printed are supplied to the device 1*d* by means of the conveyor 3 with the corona tunnel 4 and are transferred in each case individually to a container support 9 by means of the transport star 6. Once the containers 2 have been printed on the transport section 17, the printed containers are removed from the container supports 9 by means of the transport star 12 and are forwarded to the conveyor 13.

The printing of the containers 2 is once again executed in several chronological printing steps, in each printing step a number of containers 2 that corresponds to the number of print heads 19 of the print head units 18.1-18.6, i.e. in the case of the device 1*d* in each case two containers 2 being printed simultaneously or substantially simultaneously with the two different colors associated with the print head units (at the print head units 18.1/18.4, 18.2/18.5) or with the finish that forms the sealing or protective coating and a printing ink (at the print head units 18.3/18.6). During each printing step the print heads 19 of the print head units 18.1-18.6 are adjacent a container 2. The printing is carried out by rotating the containers 2, for example, by three hundred sixty degrees with the devices 20 activated such that the printing ink applied with one print head 19 is dried by the device 20 following said print head in the direction of rotation of the respective container 2 before a printing ink or finish is applied once again in the same printing step by the other print head 19. During each printing step the printing unit 18*a* is entrained in the same direction and in a synchronous or substantially synchronous manner with the transport unit. At the end of the printing step the printing unit 18*a* is moved back into the initial position so that in another printing step a print application can then be effected with the print head units 18.1 and 18.4 onto still unprinted containers 2 in each case and a print application can be effected with the print head units 18.2, 18.3 and 18.5, 18.6 onto such containers 2 that have already been printed in a previous printing step with the print head units 18.1, 18.4 or 18.2, 18.5.

Figure 16:
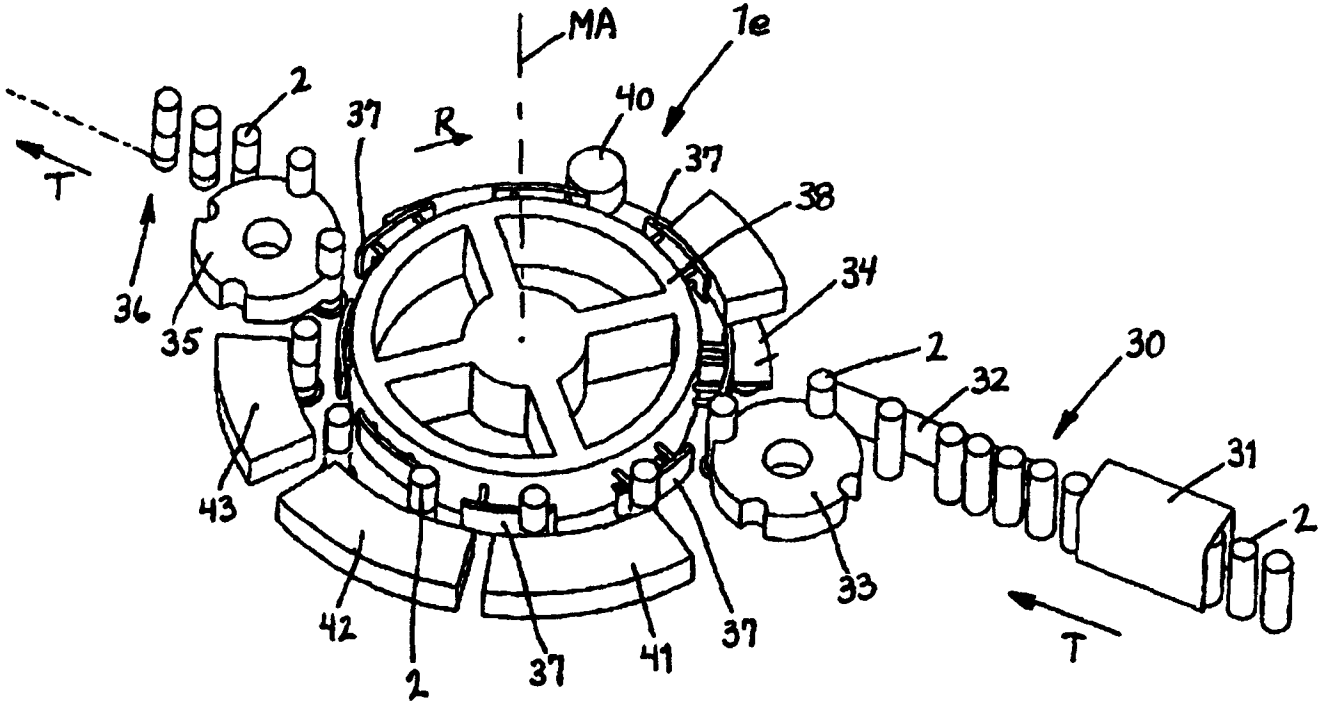
FIGS. 16 and 17 show a schematic, perspective representation and top view of another possible embodiment of the device according to the present application.
Figure 17:
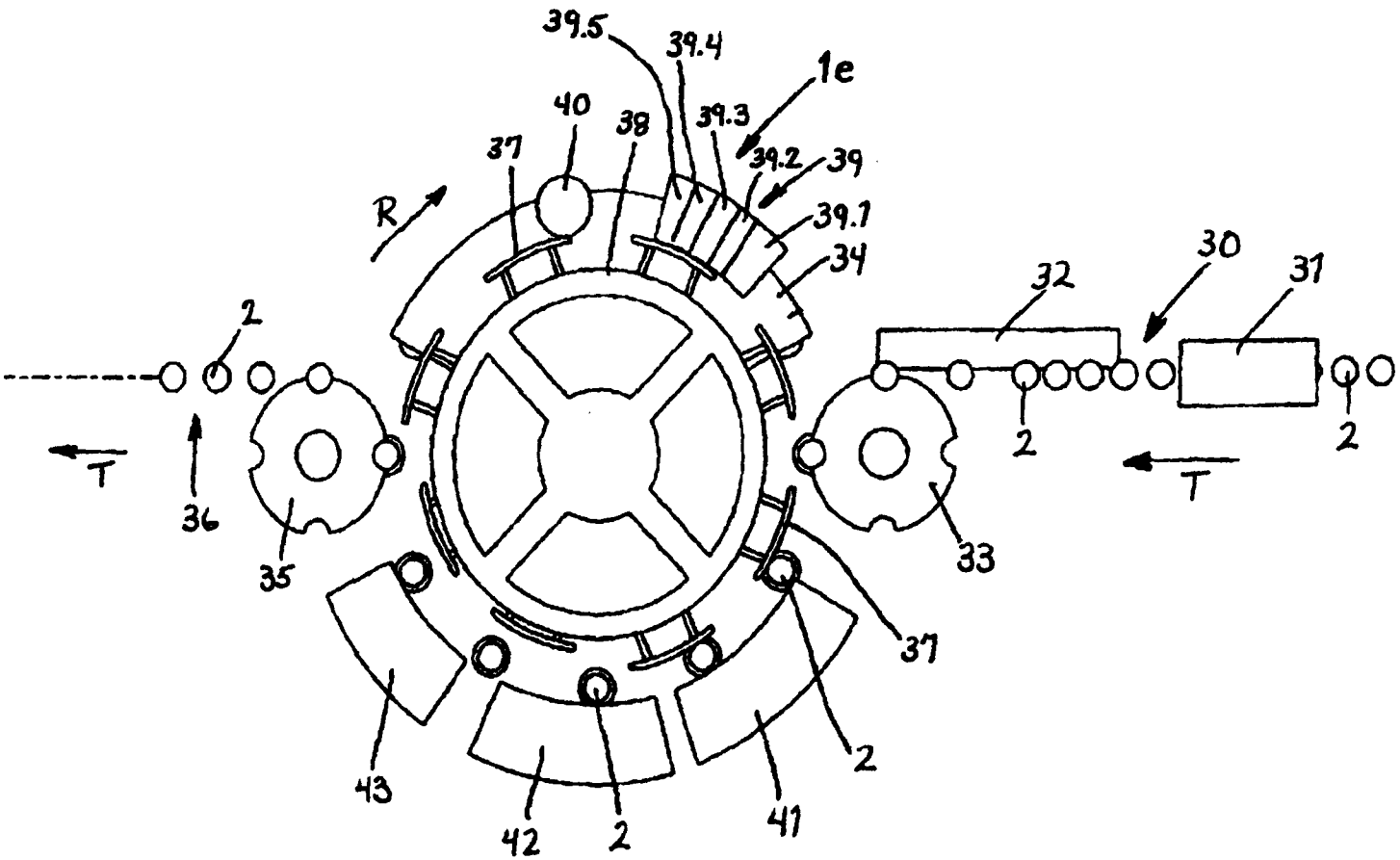

Whereas, in the case of the abovementioned devices 1-1 *d*, the printing of the containers 2 in multiple colors on their container outer surface is effected directly with the printing groups or their print heads, FIGS. 16 and 17 show a device 1*e* for printing containers 2 in multiple colors in a transfer print. The printing in multiple colors is once again effected on the container outer surface or container outside surface and in this case in one possible embodiment, with regard to the container axis, on a rotationally symmetrically realized region of the container outer surface, for example on a circular cylindrical-shaped or frustum-shaped region of the container outer surface.

By means of a conveyor, which is schematically represented in FIGS. 16 and 17 and identified with the reference 30, the containers 2 are supplied to the device 1*e* in the direction of transport specified by the arrow T, standing upright and in a single-track container flow, and having passed a corona tunnel 31 provided on the conveyor 30 and a separating screw 32 they reach a rotor or turntable 34 of the device 1*e* by means of a transport star 33. At the rotor 34 the containers 2 are retained so as to be rotatable about their container axes at container supports provided at that location (not shown) and are moved during the printing with the rotor 34 on a circular transport section. The printed containers are removed from the rotor 34 by a transport star 35 and are forwarded to a conveyor 36.

The printing of the containers 2 in multiple colors is effected by using transfer pads 37, which are provided on the periphery of a transfer drum 38, which is rotatably driveable about the machine axis MA in the direction of rotation R of the rotor but at a speed that is increased compared to the rotational speed of the rotor 34. The transfer pads 37 are provided at the transfer drum 38 so as to be adjustable radially relative to the machine axis MA between a switched-on position located radially further outside and a switched-back position located radially further inside. In addition, the transfer pads 37 are positioned such that they move with their outer face, curved in an arcuate manner about the machine axis MA, inside the circular path of movement of the containers 2 or of the container supports between the transport stars 33 and 35.

A printing group 39 is provided in the direction of rotation R of the rotor 34 or of the transfer drum 38 upstream of the transport star 33, with which printing group the printed image to be discharged onto the container 2 is applied to the outer face of the transfer pad 37. The printing group 39 comprises a plurality of print heads 39.1-39.4 following one another in the direction of rotation R of the rotor for different colors, for example for yellow, magenta, cyan and black or for generating the various color sets.

The print heads 31.1-31.4 are digitally controllable print heads of the ink jet print head type, for example print heads that are commercially available under the name "XAAR" or "Xaar500." The print heads 31.1-31.4 each comprise accordingly a housing with a plurality of individually actuatable print nozzles or nozzle openings for discharging printing ink in the distribution and quantity corresponding to the respective printed image or color print onto the background to be printed, i.e. in the present case onto the outside surface to be printed of each transfer pad moved past the printing group 39. The printing nozzles positioned with their axes horizontally or substantially horizontally are positioned at each print head 39.1-39.4 in at least one row parallel or substantially parallel to the vertical machine axis MA. The discharging of the printing ink is achieved through corresponding actuation of electrodes or of piezo elements or actuators in the print heads, for example at an actuating frequency up to fifty kiloHertz and a relative movement between the respective print head and the surface of a transfer pad to be printed of about five hundred sixty millimeters per second. The number of print nozzles per print head, for example, is in the range of five hundred with a print width of seventy millimeters. The print heads 39.1-39.4 include printing inks each in different colors, namely yellow, magenta, cyan and black.

In the direction of rotation R of the rotor upstream of the printing group 39 there is a cleaning station 40, for example in the form of a cleaning roller, by means of which any printing ink or ink residue is removed from the print or transfer pad 37 before a new printed image is applied.

At the region of the rotor 34 utilized for printing the containers 2, said region in the possible embodiment represented corresponding to an angular region of approximately one hundred eighty degrees, following the inlet star 33 there is provided a device 41 for applying a finish forming a sealing or protective coating on the respective container print, connecting thereto in the direction of rotation R of the rotor a device 42 for drying the container print, including the sealing and protective coating, for example by application of energy, for example heating or UV light and connecting thereto directly in front of the outlet star 35 an optoelectric control system 43, by means of which the printed containers are checked with regard to the quality of the print whilst rotating about their vertical axes so that wrongly printed containers 2 can then be discharged on the conveyor 36.

In detail, the printing of the containers 2 is effected with the device 1*e* in such a manner that the containers 2 transferred individually in each case with the inlet star 33 to the rotor 34 or to the container supports at that location are rolled over by the switched-on transfer pads, provided with the printed images on the outer surface, by reason of the transfer drum 38 that rotates somewhat faster compared to the rotor 34, the containers therefore roll off the transfer pads by rotating about their vertical container axes and consequently the printed image is transferred from the respective transfer pad onto a container 2. As the respective transfer pad 37 is still rolling off, that is still inside the transfer region, the containers 2 are moved past the device 41, by means of which the finish that forms the sealing or protective coating is applied to the respective container, rotating about the container axis in a continuous or substantially continuous manner, onto the part of the container print already generated by rolling off the transfer pad 37 on the outer surface of the container.

The devices 41 and 42 and the control system 43 are situated with the rotor 34 in a non-entraining manner on the periphery of the path of movement of the containers 2.

After the completed transfer of the printed image from the transfer pad 37 onto the outer surface of the relevant container 2 or after the completed rolling off of said container on the relevant transfer pad 37 and after the completed applying of the sealing or protective coating, the relevant transfer pad 37 is switched back and the respective container 2, continuing to be rotated about its container axis, is moved past the device 42 for drying the print and past the control system 43 and finally is discharged with the transport star 35 onto the conveyor 36.

After passing the transport star 35, the transfer pads 37 are switched-on once again, i.e. moved radially outwards for the cleaning process at the cleaning station 40 and for the application of a new printed image at the printing group 39.

The treatment of the containers 2 in the corona tunnel 31 and the electrostatic charging of the containers 2 at that location produce a substantial improvement in the multi-color print that is generated with the transfer print onto the outer surfaces of the containers.

Figure 18:
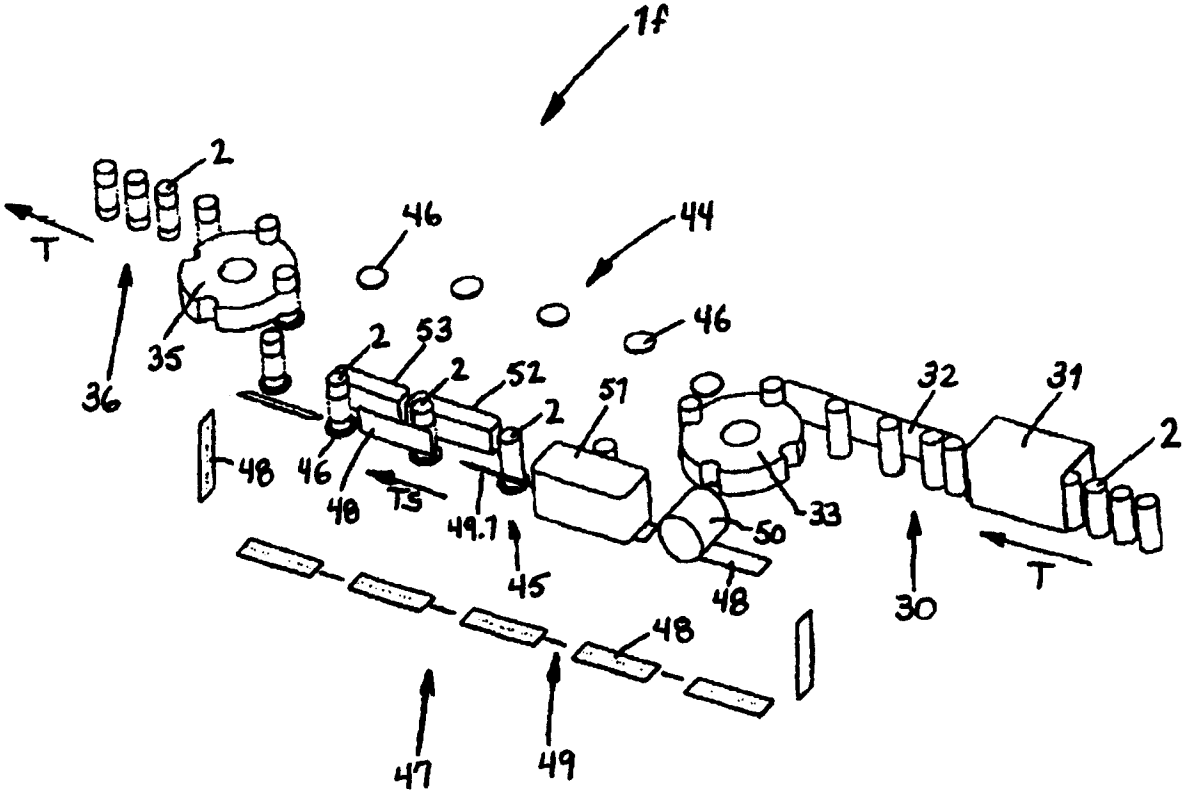
FIGS. 18 and 19 show a schematic, perspective representation and top view of another possible embodiment of the device according to the present application.
Figure 19:
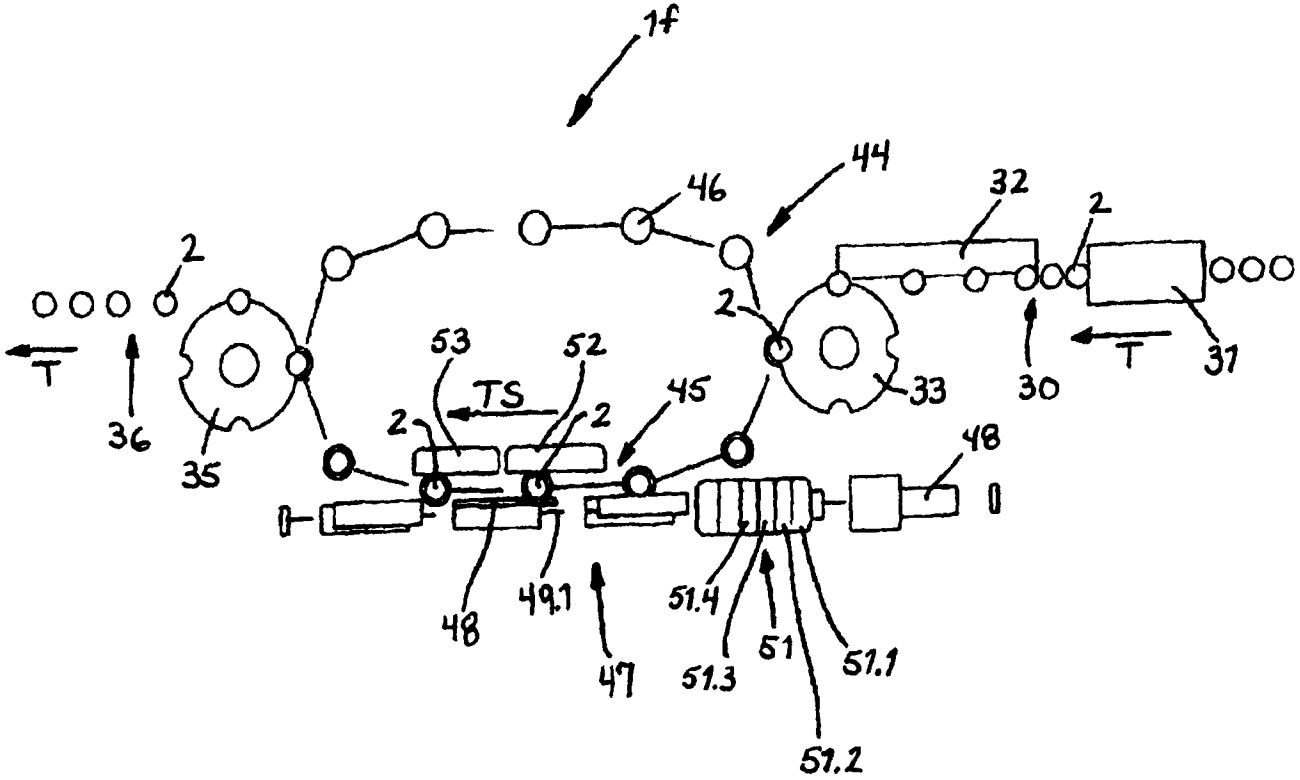
Figure 20:
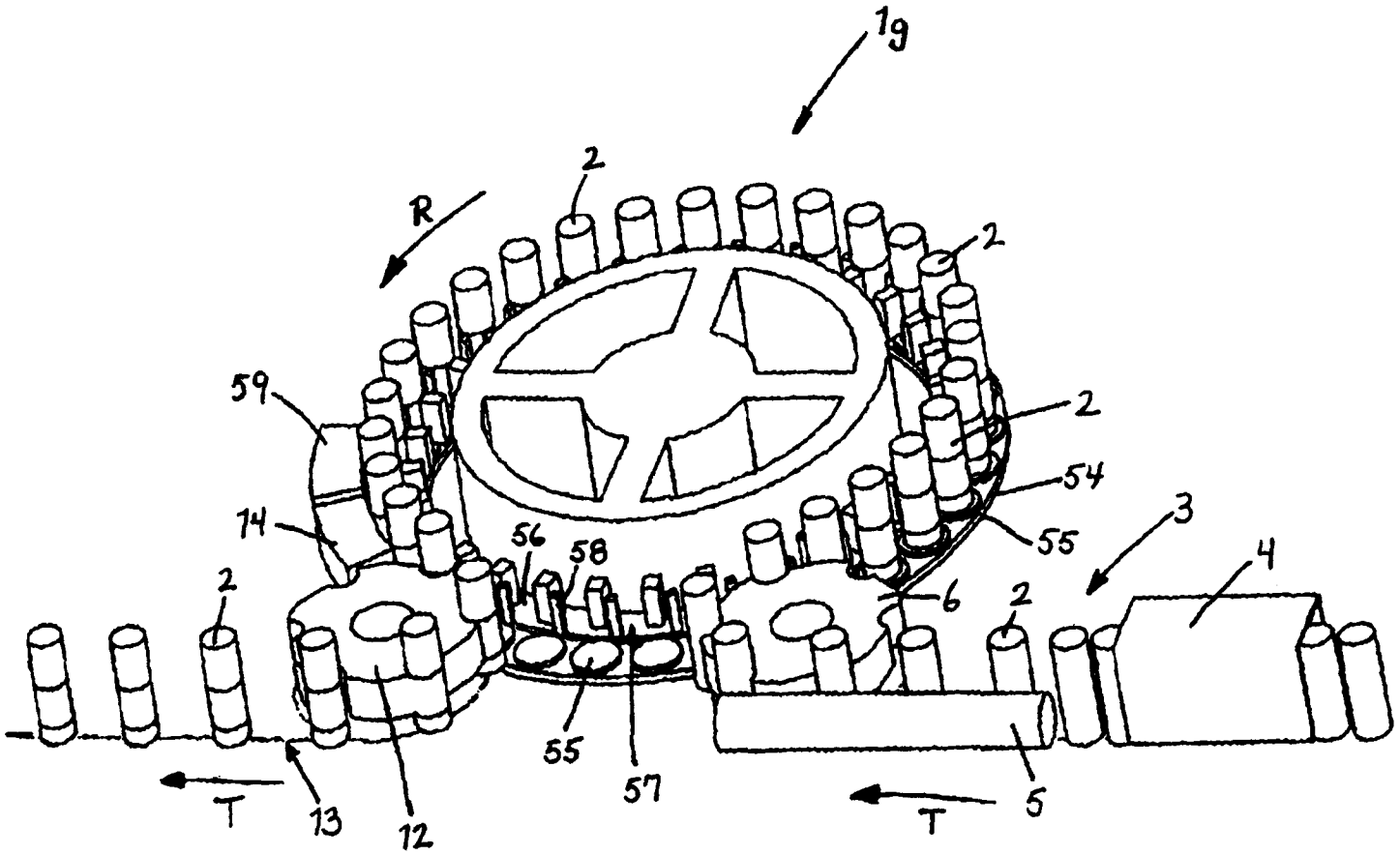
FIGS. 20 and 21 show a schematic, perspective representation and top view of another possible embodiment of the device according to the present application.
Figure 21:
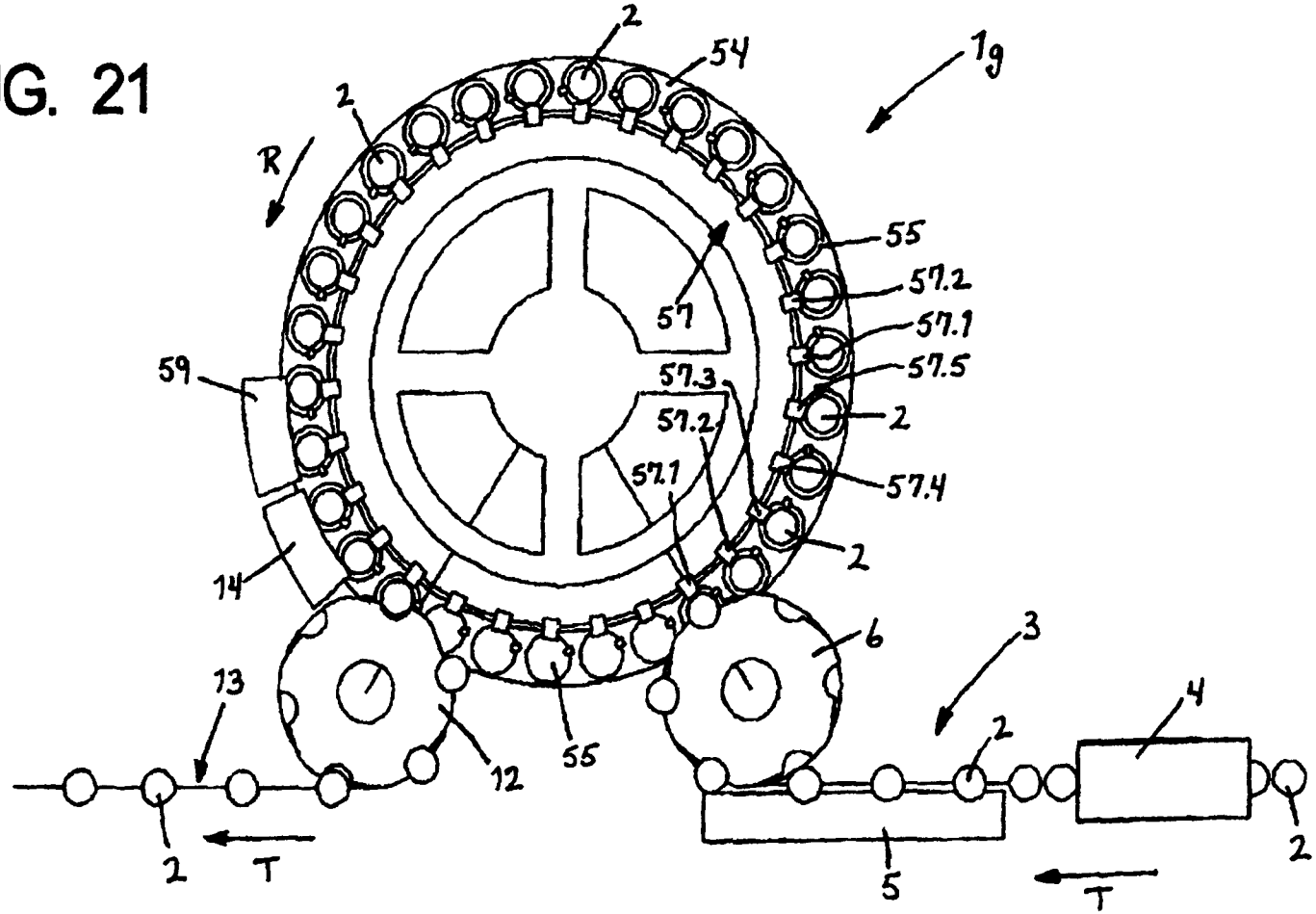

In a very schematic representation, FIGS. 18 and 19 show a device 1*f* that is once again realized for a transfer print in multiple colors on the outer surfaces of containers 2. In the case of this device, the printing of the containers 2 is effected on a transport system 44 that forms a closed loop and is driven in an endlessly or virtually endlessly circulating manner or respectively on a substantially linear transport section 45 of said system. Container supports 46 are provided at regular spacings on the transport system 44. The containers 2 to be printed are supplied to the transport section 45 via the conveyor 30 with the corona tunnel 31 and are transferred individually in each case via the transport star 33 to a container support 46, with which the relevant container 2, retained so as to be rotatable about its container axis, is moved during the printing in the direction of transport TS to the transport star 35, by means of which the printed containers 2 are removed from the transport system 44 and forwarded to the conveyor 36.

For printing the containers 2 in multiple colors, there is a print device 47 provided at the transport section 45 that includes a plurality of transfer elements or transfer pads 48, which are provided at an auxiliary conveyor 49 so as to be rotating with said auxiliary conveyor, said auxiliary conveyor forming a closed loop. The auxiliary conveyor 49 having the transfer pads 48 forms a vertical loop that is provided with its upper horizontally extending loop length 49.1 parallel or substantially parallel to the transport section 45 and directly adjacent or substantially adjacent to said transport section on one side. In their initial position, the transfer pads 48, which, for example, are substantially rectangular and with their longitudinal extension are oriented in the circumferential direction or in the direction of movement of the auxiliary conveyor 49, are positioned with their surface sides in planes perpendicular or substantially perpendicular to the loop plane of the auxiliary conveyor 49.

The auxiliary conveyor 49 is driven in such a manner that its upper length 49.1 moves in the direction of transport TS of the transport section 45, however at a greater speed than the transport section 45.

At the upper length 49.1, following one another in the direction of transport TS there is provided a cleaning station 50 in the form of a cleaning roller for removing printing ink residue on the transfer pads 48 and then a printing group 51. The printing group 51 comprises a plurality of print heads 51.1-51.5 following one another in the direction of transport TS, said print heads being realized, for example, in an identical or substantially identical manner to the print heads 39.1-39.5, however being positioned in such a manner that the print nozzles of said print heads are oriented with their axes in the vertical direction and the rows on each print head formed by the print nozzles are oriented in the horizontal or substantially horizontal direction perpendicularly or substantially perpendicularly or at right angles to the direction of transport TS. The printing group 51, positioned above the path of movement of the transfer pad 48, executes the printing of each transfer pad 46 moved past on the top side positioned in a horizontal or substantially horizontal plane. After the printing each transfer pad 48 is set up such that with its side that has the printed image, it is positioned in a vertical or substantially vertical plane parallel or substantially parallel to the direction of transport TS such that the respective container 2 to be printed, being rotated about its container axis, rolls off a transfer pad 48 and in so doing the printed image is transferred from the transfer pad 48 to the outer surface of the container. At the same time a device 52 applies the sealing or protective coating and a device 53 dries the print.

The device 1*f* also offers, among other things, the advantage of it being possible to position the print heads of the print group 51 that operate according to the ink jet print head principle in a position that is optimum for the method of operation, namely with their print nozzles above the path of movement of the transfer pads 48 and with the axes of the print nozzles oriented downwards in the vertical or substantially vertical direction.

Once the printed image has been transferred, the relevant transfer pad 48 is pivoted back again into its initial position.

In a very schematic manner, FIGS. 20, 21, 22A, 22B, and 22C show a device 1*g* that is realized similar to the devices 1, 1*a*-1*d* for printing containers 2 in multiple colors on their outer surfaces by applying the printing ink directly onto the outer surface of the container. In the case of this device, the printing is executed on a transport element in the form of a rotor 54, which is rotatably driven about the vertical machine axis (arrow R) and on which are provided container supports 55, offset from one another at regular angular spacings about the vertical machine axis, for the containers 2 standing upright, i.e. with their container axes oriented in the vertical direction. A ring-shaped print head support 56, which is positioned in an axially identical or substantially identical manner to the machine axis, is provided inside the path of movement of the container supports 55, on said print head support in the same spacing or at the same angular spacing that is between the container supports 55, print heads 57.1-57.4 are provided for printing inks in the various colors, namely in yellow (print head 57.1), in magenta (print head 57.2), in cyan (print head 57.3) and black (print head 57.4) along with other print heads 57.5 for applying the coating or protective finish. The print heads 57.1-57.5 are each provided in groups on the print head support 56 in such a manner that each group has the print heads 57.1-57.5 once and the print heads 57.1-57.5 in each group have the same sequence, i.e. for example are provided following one another in the order of their reference numbers in the circumferential direction of the print head support 56, for example in opposition to the direction of rotation R of the rotor 54. The arrangement of the print heads 57.1-57.5 is additionally such that in each printing stage (e.g. positions in FIGS. 22A and 22C) one print head 57.1-57.5 is always or virtually always situated directly opposite or substantially opposite a container 2 or its outside surface in the printing position. In this possible embodiment, the print heads 57.1-57.5 together with the print head support 56 form the printing group 57.

For printing, the containers 2 are once again supplied to the inlet or transport star 6 via the corona tunnel 4 and the separating screw 5 (arrow T) and are transferred in each case individually from said inlet or transport star to a printing station formed by a container support 55. The printed containers 2 are removed at the outlet or transport star 12 and supplied via the conveyor 13 to another use (arrow T).

The container 2 is printed in multiple colors during the transport with the rotor 54 between the inlet star 6 and the outlet star 12. The color sets forming the respective multicolor print and the connecting protective coating are applied in each case one after the other with the print heads 57.1-57.4 or with the print head 57.5 with the containers 2 being rotated or pivoted in a controlled manner about the container axes with the container supports 55, for example with a controlled rotational movement in each case about three hundred sixty degrees.

Figure 22C:
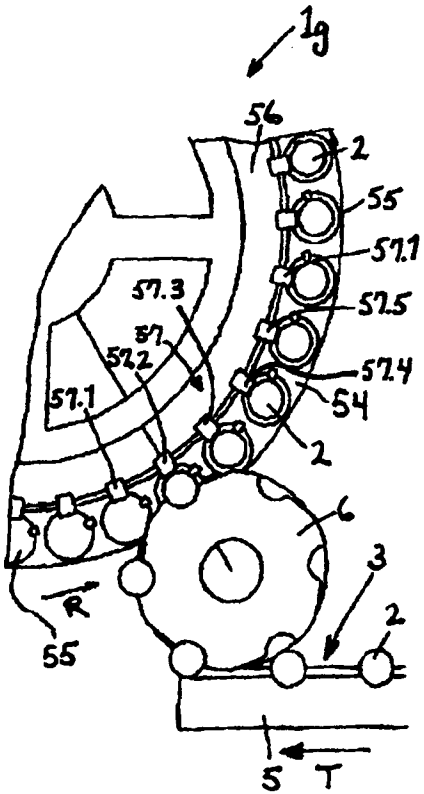
FIGS. 22A, 22B, and 22C show a schematic representation and part representation in each case, of different operating states of the device in FIGS. 20 and 21, in various positions.
Figure 22B:
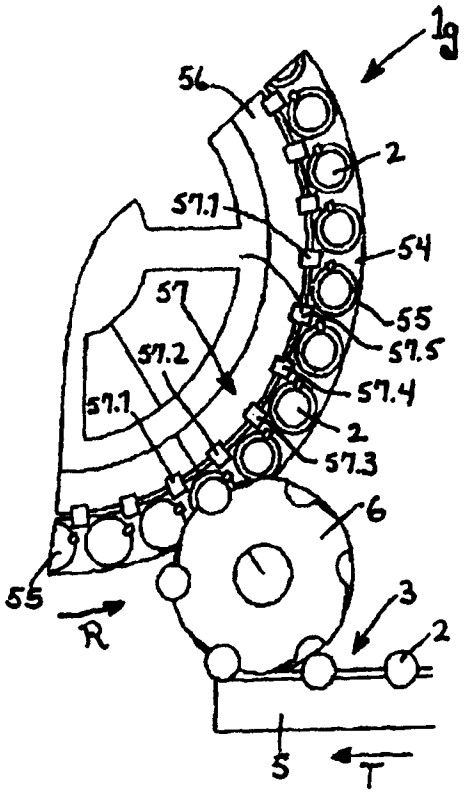
Figure 22A:
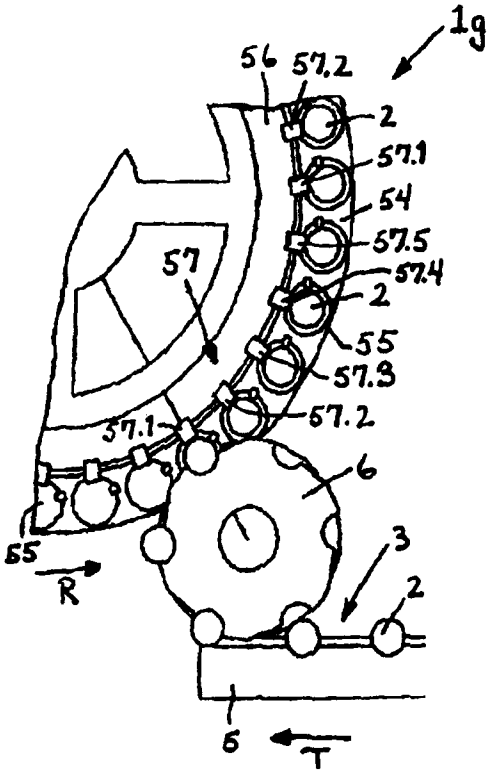

In detail, the printing of each container 2 is executed such that, after being transferred from the inlet star 6 the container 2 is situated opposite a container support 55 in a first angular region of the rotational movement of the rotor 54, i.e. in a first printing stage it is situated opposite or substantially opposite a print head for generating a first color set, for example the print head 57.1 (FIG. 22A). During this printing stage the print head support 56 is entrained in the same direction and in a synchronous or substantially synchronous manner with the rotor 54. When the color set is applied, the container 2 is rotated in a controlled manner about its vertical container axis by three hundred sixty degrees and at the same time the printing ink applied in each case is dried by means of a suitable device 58 that is associated with each print head 57.1-57.5.

The printing stage for applying another color set or for applying the protective coating that follows the first or in each case another printing stage is introduced by the container support 55 or all or essentially all the print heads 57.1-57.5 being stopped for a short time or being moved by a spacing in opposition to the rotational movement so that the containers "overtake" the print heads 57.1-57.5 by a spacing (distance between the print heads) (FIG. 22B) and thus another print head is situated opposite or substantially opposite each container 2 in a printing position, for example, after the print head 57.1 the print head 57.2, after the print head 57.2 the print head 57.3, after the print head 57.3 the print head 57.4 or after the print head 57.4 the print head 57.5. It is obvious that in each printing stage following a previous printing stage that is effected once again on an angular region of the rotational movement of the rotor 54, the print head support 56 or the print heads 57.2-57.5 are also entrained with the rotor 54 in a synchronous or substantially synchronous manner at the identical or substantially identical speed and in the same direction.

With rotor 54 the printed containers 2 are moved past a hardening or curing station 59 for complete hardening of the printing ink and of the protective coating and then, connected thereto, before reaching the outlet star 12, are moved past a control station or a control system 14, by means of which the print on the container moved past said system and also rotated about its vertical container axis is checked so that any containers with a faulty print can be discharged on the conveyor 13.

In the case of the device 1*g*, the number of container supports 55 on the rotor 54 is an integer multiple of the number of print heads 57.1-57.5 in each print head group. Accordingly, the angular spacing or spacing between container support 55 in the case of the device 1*g* is equal to 360°/(n1×n2), wherein n1=number of print heads 57.1-57.5 per print head group, namely for example five n2=number of print head groups on the print head support 56.

It has been assumed above that the print head change between two printing stages following one after the other is effected by slowing down the print head support 56 briefly so that the print heads 57.1-57.5 are "overtaken" by the containers 2. In principle, a print head change is also obviously possible in the reverse manner by briefly accelerating the print head support 56 in each case so that the container supports 55 or the containers 2 are "overtaken" by the print heads 57.1-57.5 during the print head change. In each case, however, the print head support 56 in the printing stage after the print head change and before a new print head change is driven in the same direction and in a synchronous or substantially synchronous manner with the rotor 54.

For reasons of simplicity, the print head support 56 is represented as a ring in FIGS. 20, 21, 22A, 22B, and 22C. In the embodiment of the device 1*g* in practice, it is possible for said support to have any arbitrary embodiment that can be used for the function. Thus it is possible, in at least one possible embodiment of the present application, to realize the print head support 56, for example, in two parts at least, comprising at least one first element that is entrained with the rotor 54 and at least one other guided element, which is provided at said first element and is switchable further for the respective print head change relative to the first element about the vertical machine axis through stepwise rotation by a spacing (distance between the print heads 57.1-57.5), for example in opposition to the direction of rotation R of the rotor 54 or in said direction of rotation.

The device 1*g* has, among other things, the advantage that at least the larger part of the angle of the rotational movement of the rotor 54 is available for the printing process, the number of print heads 57.1-57.5 can nevertheless be kept relatively small such that the total number of print heads 57.1-57.5, for example, is equal to the number of container supports 55, and the respective print head change can be effected through short movement strokes.

In the case of the device 1*g* also, the print heads 57.1-57.2 are positioned once again inside the path of movement of the containers 2 on the rotor 54 so that the applying of the printed images or of their color sets is supported by the centrifugal force of the rotating rotor 54 and print head support 56.

The present application has been described above by way of possible embodiments. It is obvious that numerous changes and variations are possible without departing from the teaching concept underlying the present application.

Thus it has been assumed above that during the printing the containers 2 stand with their container bottom on a container support or on a surface of a rotor or of a transport system. Obviously embodiments are also possible where the containers 2 are retained in another manner during the printing, for example suspended at a container or neck flange provided in the region of the container mouth.

It has also been assumed above that the drying of the respective color set is effected during the printing. In principle, however, it is also possible for the drying not to be effected until the respective color set has been applied to the outer surface of the container.

Figure 23:
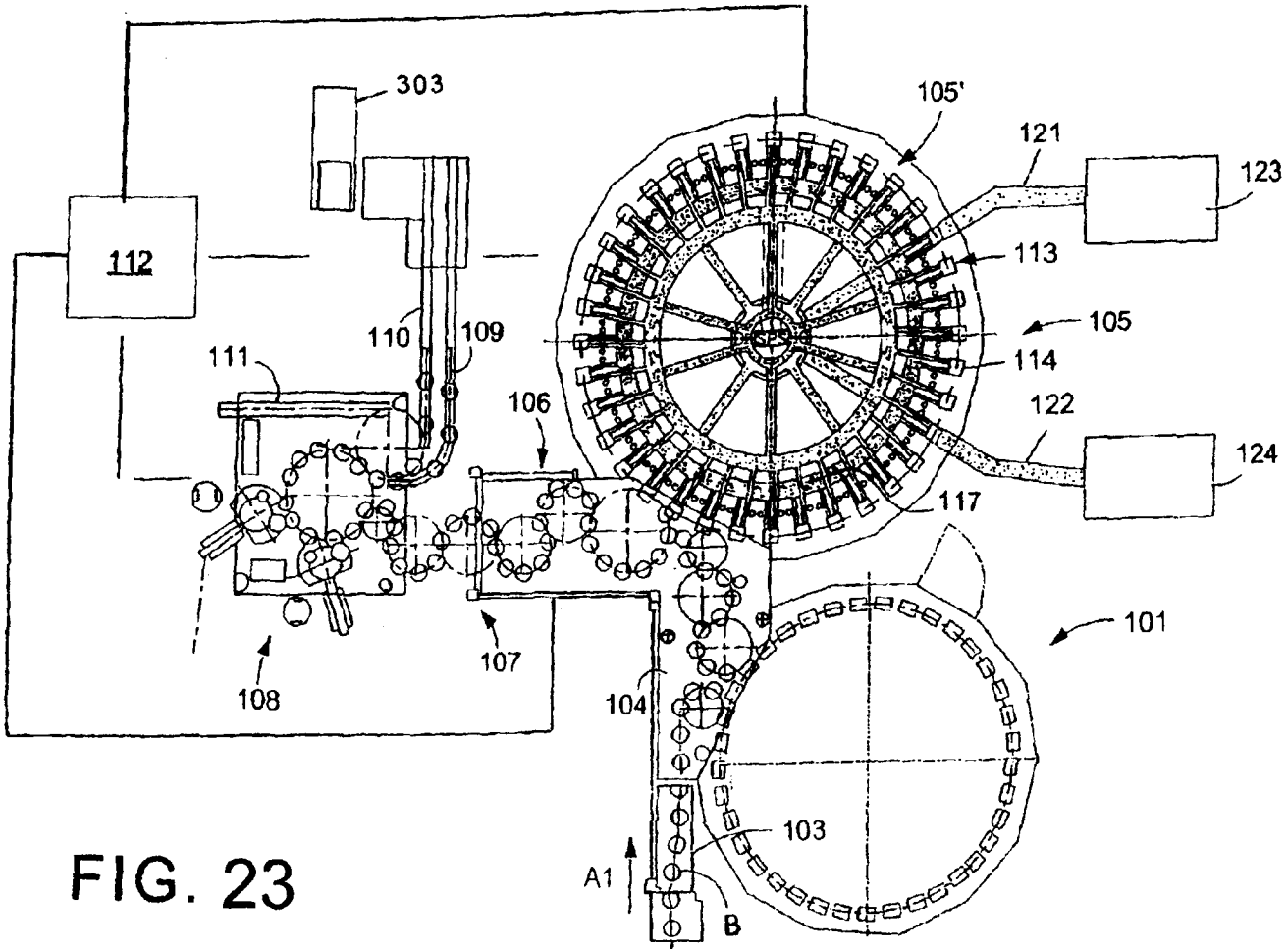
FIG. 23 shows schematically the main components of one possible embodiment example of what may be a typical system for filling containers.

FIG. 23 shows schematically the main components of one possible embodiment example of what may be a typical system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 23 shows a rinsing arrangement or rinsing station 101, to which the containers, namely bottles B, are fed in the direction of travel as indicated by the arrow A 1, by a first conveyer arrangement 103, which can be a linear conveyor or a combination of a linear conveyor and a starwheel. Downstream of the rinsing arrangement or rinsing station 101, in the direction of travel as indicated by the arrow A 1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 23, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

After sorting, bottles B that are ready to be packed can be directed to a packing or packaging station 303 and packaged for shipment out of the plant.

The beverage bottling plant can be controlled by a central control arrangement 112, which could be, for example, computerized control system that monitors and controls the operation of the various stations and mechanisms of the beverage bottling plant.

One feature or aspect of an embodiment is believed at the time of the filing of this patent application to possibly reside broadly in a device for printing, in particular for printing containers 2 in multiple colors on at least one outer surface of the container, said device including a print that is formed by at least one printed image, at least one printing group 10, 10*a*, 18, 18*a*, 57 with at least two print heads 10.1-10.5, 18.1-18.6, 19, 19, 57.1-57.5 that operate according to the ink jet print head principle for generating part printed images of the printed image that is to be applied to the outer surface of the container in at least one printing step, and a transport element 7, 16, 54 by means of which the containers 2 are moved in a direction of transport R, TS during the printing, wherein the printing groups 10, 10*a*, 18, 18*a*, 57 or their print heads 10.1-10.5, 18.1-18.6, 19, 19, 57.1-57.5 are moved, at least during part of the at least one printing step, by means of the transport element 7, 16, 54, characterized in that the print heads 10.1-10.5, 18.1-18.6, 19, 57.1-57.5 are switchable on and switchable off for a print head change or part print change in such a manner that a print head 10.1-10.5, 18.1-18.6, 19, 57.1-57.5 situated in a printing position at the relevant container 2 is movable out of the printing position and another print head 10.1-10.5, 18.1-18.6, 19, 57.1-57.5 is movable into the printing position.

Another feature or aspect of an embodiment is believed at the time of the filing of this patent application to possibly reside broadly in the device comprising means 9 for rotating the containers 2 about their container axes during the printing.

Yet another feature or aspect of an embodiment is believed at the time of the filing of this patent application to possibly reside broadly in the device, wherein for printing part printed images, the print heads 10.1-10.5, 18.1-18.6, 19, 57.1-57.5 are realized in the form of different color sets of a multicolored printed image.

Still another feature or aspect of an embodiment is believed at the time of the filing of this patent application to possibly reside broadly in the device, wherein the transport element 7, 16, 54 forms a transport section 17 between a container inlet 6 and a container outlet 12, the containers 2 being moved on said transport section during the printing.

A further feature or aspect of an embodiment is believed at the time of the filing of this patent application to possibly reside broadly in the device, wherein a plurality of printing stations 8, 55 for one container 2 in each case is provided on the transport element 7, 16, 54.

Another feature or aspect of an embodiment is believed at the time of the filing of this patent application to possibly reside broadly in the device, wherein each printing station 8 provided on the transport element 7, 16, 54 has at least one container support 9 for the receiving of one container 2.

Yet another feature or aspect of an embodiment is believed at the time of the filing of this patent application to possibly reside broadly in the device, wherein a device 11, 20 for drying the printing ink applied onto the container surface or the relevant part printed image is associated with each print head 10.1-10.5, 18.1-18.6, 19, 57.1-57.5 or with a group of print heads.

Still another feature or aspect of an embodiment is believed at the time of the filing of this patent application to possibly reside broadly in the device, wherein an independent printing group 10, 10*a* with a plurality of print heads 10.1-10.5 is associated with each printing station 8 on the transport element 7, 16, and in that the print heads 10.1-10.5 are provided on the transport element so as to be adjustable or switchable further for the part print change.

A further feature or aspect of an embodiment is believed at the time of the filing of this patent application to possibly reside broadly in the device, wherein the print heads 10.1-10.5 are adjustable or switchable on the transport element 7, 16 in the direction of transport R, TS and in opposition to the direction of transport R, TS.

Another feature or aspect of an embodiment is believed at the time of the filing of this patent application to possibly reside broadly in the device, wherein the print heads 10.1-10.5 of each printing station 8 are provided on the transport element 7 so as to be pivotable for the part print change, in one possible embodiment about an axis that is offset relative to the axis of the respective container.

Yet another feature or aspect of an embodiment is believed at the time of the filing of this patent application to possibly reside broadly in the device, wherein where there is an endlessly rotatingly driveable transport element 7, 16, 54 the printing groups 10, 10*a*, 18, 18*a*, 57 are positioned such that at least at the print heads 10.1-16.1; 19 located in the print position the discharging of the printing ink is supported by centrifugal forces generated by the movement of the transport element 7, 16, 54.

Still another feature or aspect of an embodiment is believed at the time of the filing of this patent application to possibly reside broadly in the device, wherein the print heads 10.1-10.5, 18.1-18.6, 19, 57.1-57.5 located in the printing position are positioned with their print nozzles that create the print within the path of movement of the containers 2.

A further feature or aspect of an embodiment is believed at the time of the filing of this patent application to possibly reside broadly in the device, wherein an independent device 11 for drying the printing ink that has been applied onto the outer surface of the container is provided for each printing station 8, 55.

Another feature or aspect of an embodiment is believed at the time of the filing of this patent application to possibly reside broadly in the device, wherein where there is a plurality of container supports 9 provided on the transport element 7, 16 or of printing stations 8 formed by said container supports, at least one printing unit or printing group 18, 18*a* common to all the printing stations is provided, past which the containers 2 are moved and which has at least two print heads 19 for generating different part printed images and, in a synchronous manner with the movement of the transport element 7, 16, is entrainable with the transport element in a floating manner in one operating stroke TR1 out of an initial position and is movable back into the initial position in one return stroke TR2 in opposition to the direction of transport R, TS of the transport element 7, 16 so that in each operating stroke at least one container 2 located at a printing station is printed with the associated part image.

Yet another feature or aspect of an embodiment is believed at the time of the filing of this patent application to possibly reside broadly in the device, wherein the distance between the at least two print heads 21 is identical to the distance between the printing stations 8 or container supports 9 on the transport element 7, 16.

Still another feature or aspect of an embodiment is believed at the time of the filing of this patent application to possibly reside broadly in the device, wherein the printing group 18, 18*a* for each part printed image has at least one print head unit 18.1-18.6 with at least two print heads 19 for the simultaneous printing of at least two containers 2.

A further feature or aspect of an embodiment is believed at the time of the filing of this patent application to possibly reside broadly in the device, wherein the distance between the print heads 19 at the printing group 18, 18*a* in the direction of transport R, TS of the transport element 7, 16 is identical to the distance between the printing stations 8 or container supports 9 on the transport element 7, 16.

Another feature or aspect of an embodiment is believed at the time of the filing of this patent application to possibly reside broadly in the device, wherein the at least one printing group 18, 18*a* is pivotable by a stroke that corresponds to a machine spacing out of the initial position into the end position and out of said end position back into the initial position, and in that the machine spacing is identical to the distance between axes or the angular separation of two adjacent printing stations 8 or container supports 9 on the transport element 7, 16 multiplied by the number of print heads 19 on each print head unit 18.1-18.6.

Yet another feature or aspect of an embodiment is believed at the time of the filing of this patent application to possibly reside broadly in the device, wherein a device 20 for drying or setting the printing ink is provided for each print head 19 of the print head units 18.1-18.6.

Still another feature or aspect of an embodiment is believed at the time of the filing of this patent application to possibly reside broadly in the device, wherein the devices 20 for drying the printing ink are switchable on and switchable off.

A further feature or aspect of an embodiment is believed at the time of the filing of this patent application to possibly reside broadly in the device, wherein the at least one floating printing unit or printing group 18 is provided inside and/or outside the rotatably driveable transport element 7, 16.

Another feature or aspect of an embodiment is believed at the time of the filing of this patent application to possibly reside broadly in the device, wherein where there is a plurality of container supports 55 provided on the transport element 54 or printing stations formed by said container supports, at least one common printing group or printing unit 57 is provided for all the printing stations, said printing group or printing unit having at least two print head groups, each with at least two print heads 57.1-57.5 per print head group for generating different part printed images and, during the printing stage for generating each part printed image, being entrained in the same direction and in a synchronous manner with the movement of the transport element 54, such that in each printing stage at least one print head 57.1-57.5 of each print head group is situated in a printing position at a container 2, and in that for the print head change, the movement of the printing unit 57 or of the print heads 57.1-57.5 can be slowed down or accelerated in such a manner and after the print head change can be synchronised again in such a manner with the movement of the transport element 54 that after the print head change a print head 57.1-57.5 of each print head group is once again situated in a printing position with the respective container 2.

Yet another feature or aspect of an embodiment is believed at the time of the filing of this patent application to possibly reside broadly in the device, wherein the transport element 54 is a rotating transport element, in one possible embodiment a rotor 54.

Still another feature or aspect of an embodiment is believed at the time of the filing of this patent application to possibly reside broadly in the device, wherein the print heads 57.1-57.5 of the printing unit 57 are moveable in a circulating manner on a movement path that is closed per se.

A further feature or aspect of an embodiment is believed at the time of the filing of this patent application to possibly reside broadly in the device, wherein the print heads 57.1-57.5 are provided on a rotatably driveable print head support 56.

Another feature or aspect of an embodiment is believed at the time of the filing of this patent application to possibly reside broadly in the device, wherein the distance between the print heads 57.1-57.5 in the direction of movement of the printing unit 57 or of the print heads 57.1-57.5 corresponds to the reciprocal distance between the container supports 55 or between the printing stations formed by said container supports in such a manner that during each printing stage, each print head 57.1-57.5 is situated in the printing position with reference to a printing station or with reference to a container 2 positioned at that location.

Yet another feature or aspect of an embodiment is believed at the time of the filing of this patent application to possibly reside broadly in the device, wherein the number of print heads 57.1-57.5 is identical to the number of container supports 55 or of the printing stations formed by said container supports.

Still another feature or aspect of an embodiment is believed at the time of the filing of this patent application to possibly reside broadly in the device, wherein the number of printing stations 57.1-57.5 is an integer multiple of the number of container supports 55 or of the printing stations formed by said container supports on the transport element 54.

A further feature or aspect of an embodiment is believed at the time of the filing of this patent application to possibly reside broadly in the device, wherein the number of container supports 55 or of the print stations formed by said container supports on the transport element 54 is an integer multiple of the print heads 57.1-57.5 of the printing unit 57.

Another feature or aspect of an embodiment is believed at the time of the filing of this patent application to possibly reside broadly in a device for printing, in one possible embodiment for printing containers 2 in multiple colors by means of a transfer print, said device including at least one printing group 39, 51 with at least two print heads 39.1-39.5; 51.1-51.5 that operate according to the ink jet print head principle for generating printed images, each consisting of at least two part printed images, onto transfer pads 37, 48 which are moved past the printing group 39, 51, said printed images being transferred onto the containers 2 by rolling off the respective containers 2 at a transfer region, a container conveyor 34, 44 by means of which the containers 2 are moved in a direction of transport R, TS during the printing and an auxiliary conveyor 38, 49 with a plurality of transfer pads 37, 48 that are moved with the auxiliary conveyor 38, 39 on a path of movement that is closed per se, wherein the container conveyor 34, 44 is a rotor 34 that is rotatably driven about a vertical machine axis MA and the auxiliary conveyor is a wheel-shaped or drum-shaped element 38 that is rotatably driveable about the machine axis MA.

Yet another feature or aspect of an embodiment is believed at the time of the filing of this patent application to possibly reside broadly in a device for printing, in one possible embodiment for printing containers 2 in multiple colors by means of a transfer print, said device including at least one printing group 39, 51 with at least two print heads 39.1-39.5; 51.1-51.5 that operate according to the ink jet print head principle for generating printed images, each consisting of at least two part printed images, onto transfer surfaces of transfer pads 37, 48 which are moved past the printing group 39, 51, said printed images being transferred onto the containers 2 by rolling off the containers 2 at a transfer region, a container transport element 34, 44 by means of which the containers 2 are moved in a direction of transport R, TS during the printing and an auxiliary conveyor 38, 49 with a plurality of transfer pads 37, 48 that are moved with the auxiliary conveyor 38, 49 on a path of movement that is closed per se, wherein the transfer pads 37, 48 are provided so as to be controllable or pivotable on the auxiliary conveyor 38, 49 in such a manner that they are oriented with their transfer surface in a horizontal or substantially horizontal manner when passing the printing group 39, 51 and abut against the outside surface of the upright containers 2 with their transfer surface at the printing position.

Still another feature or aspect of an embodiment is believed at the time of the filing of this patent application to possibly reside broadly in the device, wherein when passing the printing group 51, the transfer pads 48 are positioned below the printing group or the print heads 51.1-51.5.

A further feature or aspect of an embodiment is believed at the time of the filing of this patent application to possibly reside broadly in the device, wherein a cleaning station 40, 50 for the transfer pads 37, 48 is provided on the circumferential path of the auxiliary conveyor 38, 49 upstream of the printing group 39, 51.

Another feature or aspect of an embodiment is believed at the time of the filing of this patent application to possibly reside broadly in the device, wherein the auxiliary conveyor 49 is a transport element rotating about at least one horizontal axis, for example a transport wheel or a transport element forming at least one vertical or substantially vertical loop.

Yet another feature or aspect of an embodiment is believed at the time of the filing of this patent application to possibly reside broadly in the device, wherein the auxiliary conveyor 38, 49 is driven such that the transfer pads 37, 48 move parallel to the direction of transport R, TS of the container conveyor 34, 44 at the transfer region, but at a speed that deviates from the transport speed of the container transport element 34, 44 with regard to direction and/or magnitude.

Still another feature or aspect of an embodiment is believed at the time of the filing of this patent application to possibly reside broadly in the device, wherein the container transport element is a rotor 7 that is rotatably driveable about a vertical machine axis or a turntable or a transport system 16 with at least one transport element that forms a closed loop.

A further feature or aspect of an embodiment is believed at the time of the filing of this patent application to possibly reside broadly in the device, wherein at least one print head 10.5, 19 is used for applying a sealing or protective coating onto the respective printed image.

Another feature or aspect of an embodiment is believed at the time of the filing of this patent application to possibly reside broadly in the device, wherein in the direction of transport R, TS following the transfer region on the periphery of the container transport element 34, 44 but not being entrained by said container transport element, there is provided at least one device 41, 52 for applying a sealing or protective coating onto the respective printed image and/or a device 42, 53 for drying the respective printed image and/or the sealing and protective coating, in each case with the container 2 rotated about the container axis.

Yet another feature or aspect of an embodiment is believed at the time of the filing of this patent application to possibly reside broadly in the device, wherein a control system 14, 43 for checking the respective container print is provided at the container transport element 7, 16, 34, 44 upstream of the container outlet 12, 35.

Still another feature or aspect of an embodiment is believed at the time of the filing of this patent application to possibly reside broadly in the device, comprising a conveyor 3, 30 that includes a corona tunnel 4, 31 for supplying the containers 2 to the container inlet 6, 33 of the device 1, 1*a*-1*f*.

A further feature or aspect of an embodiment is believed at the time of the filing of this patent application to possibly reside broadly in a method for printing, in particular for printing containers in multiple colors on their container outer surface with a print that is formed by at least one printed image, by using at least one printing group 10, 10*a*, 18, 18*a*, 57 with at least two print heads 10.1-10.5, 18.1-18.6, 19, 57.1-57.5 that operate according to the ink jet print head principle for generating part printed images of the printed image to be applied to the outer surface of the container in at least one printing step, wherein the containers 2 are moved on a transport element 7, 16, 54 in a direction of transport R, TS during the printing and the printing groups 10, 10*a*, 18, 18*a*, 57 are entrained with the transport element 7, 16, 54 at least during part of the at least one printing step, characterized in that after printing a part image and before printing another part image a print head change is carried out in such a manner that a print head 10.1-10.5, 18.1-18.6, 19, 57.1-57.5 that is situated in a printing position at the relevant container 2 is moved out of the printing position and another print head 10.1-10.5, 18.1-18.6, 19, 57.1-57.5 is moved into the printing position.

Another feature or aspect of an embodiment is believed at the time of the filing of this patent application to possibly reside broadly in the method, wherein during the printing the containers are rotated about their container axes, for example by an angle of 360°.

Yet another feature or aspect of an embodiment is believed at the time of the filing of this patent application to possibly reside broadly in the method, wherein during the printing steps, part printed images are applied in the form of different color sets of a multi-colored printed image and/or in the form of at least one sealing or protective coating covering the printed image.

Still another feature or aspect of an embodiment is believed at the time of the filing of this patent application to possibly reside broadly in the device, wherein the printing of the containers 2 is effected in each case at a printing station that is provided with a plurality of printing stations 8 of a similar type on the transport element 7, 16, wherein an independent printing group 10, 10*a* with a plurality of print heads 10.1-10.5 is associated with each printing station 8, and in that for the respective part print change or print head change, the print heads 10.1-10.5 are moved relative to the printing station or to its printing position in the direction of transport R, TS and in opposition to the direction of transport R, TS and/or are pivoted or rotated about an axis, for example about an axis that is offset relative to the axis of the respective container 2.

A further feature or aspect of an embodiment is believed at the time of the filing of this patent application to possibly reside broadly in the method, wherein the print heads 10.1-10.5, 18.1-18.6, 19, 57.1-57.5 are each positioned during the printing of the part printed images such that the applying of the printing ink and/or the sealing or protective coating are supported by centrifugal forces that are generated by the movement of the transport element 7.

Another feature or aspect of an embodiment is believed at the time of the filing of this patent application to possibly reside broadly in the method, wherein the respective part printed image and/or the sealing or protective coating are dried directly after generation.

Yet another feature or aspect of an embodiment is believed at the time of the filing of this patent application to possibly reside broadly in the method, wherein the printing ink forming the respective part printed image or a compound forming the sealing or protective coating is continuously dried as it is being discharged.

Still another feature or aspect of an embodiment is believed at the time of the filing of this patent application to possibly reside broadly in the method, wherein the drying is effected by application of energy, for example by heating and/or by UV light.

A further feature or aspect of an embodiment is believed at the time of the filing of this patent application to possibly reside broadly in the method, wherein where there is a plurality of printing positions formed on the transport element 7, 16, the printing of the containers 2 is effected with at least one printing unit 18, 18*a* that is common to all printing positions, the containers to be printed being moved past said printing unit, which has at least two print heads 19, and in that the printing unit 18, 18*a*, for generating in each case a part image with the print heads, is entrained with the transport element 7, 16 out of an initial position in one operating stroke TR1 and in one return stroke TR is moved back into the initial position in opposition to the direction of transport RTS of the transport element 7, 16.

Another feature or aspect of an embodiment is believed at the time of the filing of this patent application to possibly reside broadly in the method, wherein the printing unit 18, 18*a* is moved back into the initial position after each operating stroke TR1 in such a manner that a container 2 is located at a print head 19 that is situated in the printing position.

Yet another feature or aspect of an embodiment is believed at the time of the filing of this patent application to possibly reside broadly in the method, wherein at least two containers 2 are printed with different part printed images after each operating stroke TR1.

Still another feature or aspect of an embodiment is believed at the time of the filing of this patent application to possibly reside broadly in the method, wherein in each operating stroke, in each case at least two container groups, each comprising at least two containers 2, are printed with different part printed images.

A further feature or aspect of an embodiment is believed at the time of the filing of this patent application to possibly reside broadly in the method, wherein in each operating stroke, a first part printed image is applied with at least one print head 19 on at least one container not yet printed with the printing unit or printing group 18, 18*a*, and another part printed image is applied with at least one second print head on at least one container that is already provided with a part printed image, and in that after each operating stroke TR1, the printing unit 18, 18*a* is moved back into the initial position in such a manner that at the at least one first print head 19 in each case a container 2 not yet printed with the printing unit or printing group 18, 18*a* is situated in the printing position and at the at least one other print head 19 a container 2 already printed with the printing unit or printing group 18, 18*a* is situated in the printing position.

Another feature or aspect of an embodiment is believed at the time of the filing of this patent application to possibly reside broadly in the method, wherein the printing unit or printing group 18, 18*a* in each operating stroke TR1 or return stroke TR2 is pivoted by a stroke that is identical to the distance between axes or to the angular separation between two printing positions 9 on the transport element 16, 17 or an integer multiple thereof.

Yet another feature or aspect of an embodiment is believed at the time of the filing of this patent application to possibly reside broadly in the method, wherein where there is a plurality of container supports 55 provided on the transport element 54 or of print stations formed by said container supports, at least one printing group or printing unit 57 common to all printing stations is used that has at least two print head groups, each with at least two print heads 57.1-57.5 per print head group for generating different part printed images, in that printing unit 57 during each printing stage for generating each part printed image is entrained in the same direction and in a synchronous manner with the movement of the transport element 54 such that in each printing stage at least one print head 57.1-57.5 of each print head group is situated in a printing position at a container 2, and in that for the print head change, the movement of the printing unit 57 or of the printing heads 57.1-57.5 is slowed down or accelerated in such a manner and after the print head change is once again synchronized with the movement of the transport element 54 in such a manner that, after the print head change, a print head 57.1-57.5 of each print head group is once again situated in a printing position with the respective container 2.

Still another feature or aspect of an embodiment is believed at the time of the filing of this patent application to possibly reside broadly in the method, wherein the slowing down or accelerating is effected by temporarily superposing the movement of the printing unit 57 or of the print heads 57.1-57.5 that is synchronous with the transport element 54, with another movement component in opposition to or in the direction of transport R of the transport element 54.

A further feature or aspect of an embodiment is believed at the time of the filing of this patent application to possibly reside broadly in the device, wherein the print heads 57.1-57.5 of the printing unit 57 are moved in a rotating manner on a path of movement that is closed per se.

Another feature or aspect of an embodiment is believed at the time of the filing of this patent application to possibly reside broadly in a method for printing, in one possible embodiment for printing containers 2 in multiple colors by means of a transfer print by using a printing group 39, 51 with at least two print heads 39.1-39.5; 51.1-51.5 that operate according to the ink jet print head principle, with which print heads the printed images, consisting of at least two part printed images, are applied to transfer pads 37, 48 that are moved past the printing group 39, 51, said printed images then being transferred onto the containers 2 by rolling off the containers 2 at the transfer pads, wherein during the printing the containers 2 are moved on a container transport element 34, 44 and the transfer pads are moved with an auxiliary conveyor 38, 49, characterized in that the containers 2 are moved with the container conveyor 34, 44 and also the transfer pads 37, 48 with the auxiliary conveyor 38, 49 on a circular path about a vertical axis.

Yet another feature or aspect of an embodiment is believed at the time of the filing of this patent application to possibly reside broadly in the method, wherein the transfer pads are moved on a circular path of movement within the circular path of movement of the containers 2.

Still another feature or aspect of an embodiment is believed at the time of the filing of this patent application to possibly reside broadly in a method for printing, in one possible embodiment for multiple printing, in one possible embodiment for multiple printing of containers 2 by means of a transfer print by using at least one printing group 39, 41 with at least two print heads 39.1-39.5; 51.1-51.5 that operate according to the ink jet print head principle, with which print heads the printed images, consisting of at least two part printed images, are applied to transfer pads 37, 48 that are moved past the printing group 39, 51, said printed images then being transferred onto the containers 2 by rolling off the containers 2 at the transfer pads, wherein the printing of the transfer pads 37, 48 is effected in a printing position in which the transfer surface of the respective transfer pad 37, 48 is positioned in a horizontal or substantially horizontal plane, and in that, before the transfer of the respective printed image, the transfer pads 37, 48 are pivoted into a transfer position in which the respective transfer surface abuts against the outside surface of the upright containers 2.

A further feature or aspect of an embodiment is believed at the time of the filing of this patent application to possibly reside broadly in the method, wherein during the printing, the containers 2 are moved on a container transport element 34, 44 and the transfer pads are moved with an auxiliary conveyor 38, 49.

Another feature or aspect of an embodiment is believed at the time of the filing of this patent application to possibly reside broadly in the method, wherein before the transfer of the respective printed image, the transfer pads 37, 48 are pivoted into a horizontal or substantially horizontal transfer position.

Yet another feature or aspect of an embodiment is believed at the time of the filing of this patent application to possibly reside broadly in the method, wherein the printing of the transfer pads 37, 48 is effected with print heads 51.1-51.5 positioned above the respective transfer surface.

Still another feature or aspect of an embodiment is believed at the time of the filing of this patent application to possibly reside broadly in the method, wherein the pivoting of the transfer pads 37, 48 is effected about at least one axis parallel or substantially parallel to the direction of their movement.

A further feature or aspect of an embodiment is believed at the time of the filing of this patent application to possibly reside broadly in the method, wherein the transfer pads 37, 48 for the transferring of the printed images are moved parallel to the direction of transport R, TS of the containers 2, but at a speed that deviates from the transport speed of the containers 2 with regard to direction and/or magnitude.

Another feature or aspect of an embodiment is believed at the time of the filing of this patent application to possibly reside broadly in the method, wherein the containers 2 are treated in a corona tunnel 4, 31 before the printing.

One feature or aspect of an embodiment is believed at the time of the filing of this patent application to possibly reside broadly in a container filling plant, a method of adding information on the outer surface of containers, the information comprising at least two media, the container filling plant comprising an information adding system, a machine for filling containers, and a machine for closing containers, said method comprising the steps of: a) moving a first container into a first conveying arrangement in said information adding system; b) conveying said first container with said first conveying arrangement in said information adding system; said information adding system comprising at least one information adding arrangement and at least one information transfer arrangement; each said at least one information adding arrangement comprising at least a first and a second information adding device; said first information adding device being configured and disposed to add information, in a first medium, to said at least one information transfer arrangement; said second information adding device being configured and disposed to add information, in a second medium, to said at least one information transfer arrangement, said first medium and said second medium being different; said at least one information transfer arrangement being configured to store information added thereto, with said first and said second information adding devices, and transferring the stored information to the outer surface of said first container, said at least one information transfer arrangement being disposed on a second conveying arrangement; c) moving said second conveying arrangement and disposing a first transfer arrangement at a first position proximate said at least one information adding arrangement; d) moving said first information adding device into a position for adding information to said first transfer arrangement; e) adding information in said first medium to said first transfer arrangement with said first information adding device; f) moving said first information adding device away from said position for adding information; g) moving said second information adding device into a position for adding information to said first transfer arrangement; h) adding information in said second medium to said first transfer arrangement, with said second information adding device; l) moving said second information adding device away from said position for adding information; j) storing said information added to said first transfer arrangement; k) moving said first conveying arrangement at a first speed; l) moving said second conveying arrangement at a second speed, different than said first speed of said first conveying arrangement; m) moving said first transfer arrangement to a second position, which said second position forms a non-zero angle with respect to said first position; n) disposing said first transfer arrangement proximate a portion of the outer surface of said first container and abutting said first transfer arrangement with said portion of the outer surface of said first container; o) transferring the information stored with said first transfer arrangement to said portion of the outer surface of said first container; p) moving said first container out of said information adding system and into said machine for filling containers; q) filling said first container with a filling material; r) moving said first container out of said machine for filling containers and into said machine for closing containers; s closing said first container; t) moving a second container into said first conveying arrangement in said information adding system; and u) repeating said steps b) through s) with said second container and said first transfer arrangement or a second transfer arrangement, as recited with said first container and said first transfer arrangement.

Another feature or aspect of an embodiment is believed at the time of the filing of this patent application to possibly reside broadly in a method of adding information on the outer surface of articles, such as containers in a container filling plant, the information comprising at least two media, said method comprising the steps of: a) moving a first container into a conveying arrangement in an information adding system; b) conveying said first container with said conveying arrangement in said information adding system; said information adding system comprising at least one information adding arrangement; c) moving one of said at least one information adding arrangement, disposing it proximate said first container, for adding information to an outer surface of said first container; each said at least one information adding arrangement comprising at least a first and a second information adding device; said first information adding device being configured to add information in a first medium and said second information device being configured to add information in a second medium, said first medium and said second medium being different; d) moving said first information adding device into a position for adding information to the outer surface of said first container; e) adding information in said first medium to the outer surface of said first container with said first information adding device; f) moving said first information adding device away from said position for adding information to the outer surface of said first container; g) moving said second information adding device into a position for adding information to the outer surface of said first container; h) adding information in said second medium to the outer surface of said first container, with said second information adding device; l) moving said second information adding device away from said position for adding information to the outer surface of said first container j) moving said first container out of said information adding system; k) containing a filling material in said first container; l) moving a second container into said conveying arrangement in said information adding system; and m) repeating said steps b) through k) with said second container, as recited with said first container.

Yet another feature or aspect of an embodiment is believed at the time of the filing of this patent application to possibly reside broadly in a method of adding information on the outer surface of articles wherein: said conveying arrangement comprises a transport element; said first medium comprises a printing material of a first color; said second medium comprises a printing material of a second color, said first and said second colors being different; said steps of adding information to the outer surface of said first container comprise printing an image on the outer surface of said first container; said first information adding device comprises a first print head; said second information adding device comprises a second print head; said information adding arrangement comprises a printing group comprising said first and said second print head; and said information adding system comprises said transport element and said printing group.

Still another feature or aspect of an embodiment is believed at the time of the filing of this patent application to possibly reside broadly in a method of adding information on the outer surface of articles wherein during the printing the containers are rotated about their container axes, for example by an angle of 360°.

A further feature or aspect of an embodiment is believed at the time of the filing of this patent application to possibly reside broadly in a method of adding information on the outer surface of articles wherein during the printing steps, part printed images are applied in the form of different color sets of a multi-colored printed image and/or in the form of at least one sealing or protective coating covering the printed image.

Another feature or aspect of an embodiment is believed at the time of the filing of this patent application to possibly reside broadly in a method of adding information on the outer surface of articles wherein the printing of the containers is effected in each case at a printing station that is provided with a plurality of printing stations of a similar type on the transport element, wherein an independent printing group with a plurality of print heads is associated with each printing station, and in that for the respective part print change or print head change, the print heads are moved relative to the printing station or to its printing position in the direction of transport and in opposition to the direction of transport and/or are pivoted or rotated about an axis, such as about an axis that is offset relative to the axis of the respective container.

Yet another feature or aspect of an embodiment is believed at the time of the filing of this patent application to possibly reside broadly in a method of adding information on the outer surface of articles wherein the print heads are each positioned during the printing of the part printed images such that the applying of the printing ink and/or the sealing or protective coating are supported by centrifugal forces that are generated by the movement of the transport element.

Still another feature or aspect of an embodiment is believed at the time of the filing of this patent application to possibly reside broadly in a method of adding information on the outer surface of articles wherein the respective part printed image and/or the sealing or protective coating are dried directly after generation.

A further feature or aspect of an embodiment is believed at the time of the filing of this patent application to possibly reside broadly in a method of adding information on the outer surface of articles wherein the printing ink forming the respective part printed image or a compound forming the sealing or protective coating is continuously dried as it is being discharged.

Another feature or aspect of an embodiment is believed at the time of the filing of this patent application to possibly reside broadly in a method of adding information on the outer surface of articles further comprising at least one of: a) wherein the drying is effected by application of energy, for example by heating and/or by UV light; b) wherein there is a plurality of printing positions formed on the transport element, the printing of the containers is effected with at least one printing unit that is common to all printing positions, the containers to be printed being moved past said printing unit, which has at least two print heads, and in that the printing unit, for generating in each case a part image with the print heads, is entrained with the transport element out of an initial position in one operating stroke and in one return stroke is moved back into the initial position in opposition to the direction of transport of the transport element; c) wherein the printing unit is moved back into the initial position after each operating stroke in such a manner that a container is located at a print head that is situated in the printing position; d) wherein at least two containers are printed with different part printed images after each operating stroke; e) wherein in each operating stroke, in each case at least two container groups, each comprising at least two containers, are printed with different part printed images; f) wherein each operating stroke, a first part printed image is applied with at least one print head on at least one container not yet printed with the printing unit or printing group, and another part printed image is applied with at least one second print head on at least one container that is already provided with a part printed image, and in that after each operating stroke, the printing unit is moved back into the initial position in such a manner that at the at least one first print head in each case a container not yet printed with the printing unit or printing group is situated in the printing position and at the at least one other print head a container already printed with the printing unit or printing group is situated in the printing position; g) wherein the printing unit or printing group in each operating stroke or return stroke is pivoted by a stroke that is identical to the distance between axes or to the angular separation between two printing positions on the transport element or an integer multiple thereof; h) wherein there is a plurality of container supports provided on the transport element or of print stations formed by said container supports, at least one printing group or printing unit common to all printing stations is used that has at least two print head groups, each with at least two print heads per print head group for generating different part printed images, in that printing unit during each printing stage for generating each part printed image is entrained in the same direction and in a synchronous manner with the movement of the transport element such that in each printing stage at least one print head of each print head group is situated in a printing position at a container, and in that for the print head change, the movement of the printing unit or of the printing heads is slowed down or accelerated in such a manner and after the print head change is once again synchronized with the movement of the transport element in such a manner that, after the print head change, a print head of each print head group is once again situated in a printing position with the respective container; i) wherein the slowing down or accelerating is effected by temporarily superposing the movement of the printing unit or of the print heads that is synchronous with the transport element, with another movement component in opposition to or in the direction of transport of the transport element; and j) wherein the print heads of the printing unit are moved in a rotating manner on a path of movement that is closed per se.

Yet another feature or aspect of an embodiment is believed at the time of the filing of this patent application to possibly reside broadly in a method of adding information on the outer surface of articles, such as containers in a container filling plant, the information comprising at least two media, said method comprising the steps of: a) moving a first container into a first conveying arrangement in an information adding system; b) conveying said first container with said first conveying arrangement in said information adding system; said information adding system comprising at least one information adding arrangement and at least one information transfer arrangement; each said at least one information adding arrangement comprising at least a first and a second information adding device; said first information adding device being configured and disposed to add information, in a first medium, to said at least one information transfer arrangement; said second information adding device being configured and disposed to add information, in a second medium, to said at least one information transfer arrangement, said first medium and said second medium being different; said at least one information transfer arrangement being configured to store information added thereto, with said first and said second information adding devices, and transferring the stored information to the outer surface of said first container, said at least one information transfer arrangement being disposed on a second conveying arrangement; c) moving said second conveying arrangement and disposing a first transfer arrangement proximate said at least one information adding arrangement; d) adding information in said first medium to said first transfer arrangement with said first information adding device; e) adding information in said second medium to said first transfer arrangement with said second information adding device; f) storing said information added to said first transfer arrangement with said first transfer arrangement; g) moving said first conveying arrangement at a first speed; h) moving said second conveying arrangement at a second speed, different than said first speed of said first conveying arrangement; l) disposing said first transfer arrangement proximate a portion of the outer surface of said first container and abutting said first transfer arrangement with said portion of the outer surface of said first container; j) transferring the information stored with said first transfer arrangement to said portion of the outer surface of said first container; k) moving said first container out of said information adding system; l) containing a filling material in said first container; m) moving a second container into said first conveying arrangement in said information adding system; and n) repeating said steps b) through l) with said second container and said first transfer arrangement or a second transfer arrangement, as recited with said first container and said first transfer arrangement.

One feature or aspect of an embodiment is believed at the time of the filing of this patent application to possibly reside broadly in a method of adding information on the outer surface of articles wherein said at least one information transfer arrangement comprises a plurality of transfer pads, said plurality of transfer pads are moved on a circular path of movement within a circular path of movement of said first container.

Another feature or aspect of an embodiment is believed at the time of the filing of this patent application to possibly reside broadly in a method of adding information on the outer surface of articles, such as containers in a container filling plant, the information comprising at least two media, said method comprising the steps of: a) moving a first container into a conveying arrangement in an information adding system; b) conveying said first container with said conveying arrangement in said information adding system; said information adding system comprising at least one information adding arrangement and at least one information transfer arrangement; each said at least one information adding arrangement comprising at least a first and a second information adding device; said first information adding device being configured and disposed to add information, in a first medium, to said at least one information transfer arrangement; said second information adding device being configured and disposed to add information, in a second medium, to said at least one information transfer arrangement, said first medium and said second medium being different; said at least one information transfer arrangement being configured to store information added thereto, with said first and said second information adding devices, and transferring the stored information to the outer surface of said first container; c) disposing a first transfer arrangement at a first position proximate said at least one information adding arrangement; d) adding information in said first medium to said first transfer arrangement with said first information adding device; e) adding information in said second medium to said first transfer arrangement with said second information adding device; f) storing said information added to said first transfer arrangement with said first transfer arrangement; g) moving said first transfer arrangement to a second position, which said second position forms a non-zero angle with respect to said first position; h) disposing said first transfer arrangement proximate a portion of the outer surface of said first container and abutting said first transfer arrangement with said portion of the outer surface of said first container; i) transferring the information stored with said first transfer arrangement to said portion of the outer surface of said first container; j) containing a filling material in said first container; k) moving said first container out of said information adding system; l) moving a second container into said first conveying arrangement in said information adding system; and m) repeating said steps b) through j) with said second container and said first transfer arrangement or a second transfer arrangement, as recited with said first container and said first transfer arrangement.

Yet another feature or aspect of an embodiment is believed at the time of the filing of this patent application to possibly reside broadly in a method of adding information on the outer surface of articles wherein: said conveying arrangement comprises a transport element; said first medium comprises a printing material of a first color; said second medium comprises a printing material of a second color, said first and said second colors being different; said first information adding device comprises a first print head; said second information adding device comprises a second print head; said information adding arrangement comprises a printing group comprising said first and said second print head; each said at least one transfer arrangement comprises a transfer pad; said steps of adding information to the outer surface of said transfer pads comprise printing an image on a surface of said transfer pads; and said information adding system comprises said transport element, said transfer pads, and said printing group.

Still another feature or aspect of an embodiment is believed at the time of the filing of this patent application to possibly reside broadly in a method of adding information on the outer surface of articles wherein during the printing, the containers are moved on a container transport element and the transfer pads are moved with an auxiliary conveyor.

A further feature or aspect of an embodiment is believed at the time of the filing of this patent application to possibly reside broadly in a method of adding information on the outer surface of articles wherein before the transfer of the respective printed image, the transfer pads are pivoted into a horizontal or substantially horizontal transfer position.

Another feature or aspect of an embodiment is believed at the time of the filing of this patent application to possibly reside broadly in a method of adding information on the outer surface of articles wherein the printing of the transfer pads is effected with the print heads positioned above the respective transfer surface.

Yet another feature or aspect of an embodiment is believed at the time of the filing of this patent application to possibly reside broadly in a method of adding information on the outer surface of articles wherein the pivoting of the transfer pads is effected about at least one axis parallel or substantially parallel to the direction of their movement.

Still another feature or aspect of an embodiment is believed at the time of the filing of this patent application to possibly reside broadly in a method of adding information on the outer surface of articles wherein the transfer pads for the transferring of the printed images are moved parallel to the direction of transport of the containers, but at a speed that deviates from the transport speed of the containers with regard to direction and/or magnitude.

A further feature or aspect of an embodiment is believed at the time of the filing of this patent application to possibly reside broadly in a method of adding information on the outer surface of articles wherein the containers are treated in a corona tunnel before the printing.

The components disclosed in the various publications, disclosed or incorporated by reference herein, may possibly be used in possible embodiments of the present invention, as well as equivalents thereof.

Some examples of bottling systems, which may be used or adapted for use in at least one possible embodiment of the present may be found in the following U.S. patents assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

Some examples of laser printing arrangements that may possibly be utilized or possibly adapted for use in at least one possible embodiment of the present application may possibly be found in the following U.S. patents: U.S. Pat. No. 4,847,643 issued to Ohmori on Jul. 11, 1989; U.S. Pat. No. 5,294,945 issued to Omura et al. on Mar. 15, 1994; U.S. Pat. No. 5,528,280 issued to Endo et al. on Jun. 18, 1996; U.S. Pat. No. 6,210,778 issued to Poirier et al. on Apr. 3, 2001; U.S. Pat. No. 6,433,810 issued to Katayama et al. on Aug. 13, 2002; and U.S. Pat. No. 6,655,275 issued to Mugrauer on Dec. 2, 2003.

Some examples of ink jet printing apparatus and methods that may possibly be utilized or possibly adapted for use in at least one possible embodiment of the present application may possibly be found in the following U.S. patents: U.S. Pat. No. 6,582,047 issued to Koitabashi et al. on Jun. 24, 2003; U.S. Pat. No. 6,623,093 issued to Takahashi et al. on Sep. 23, 2003; U.S. Pat. No. 6,625,351 issued to Cox et al. on Sep. 23, 2003; U.S. Pat. No. 6,652,055 issued to Oikawa on Nov. 25, 2003; U.S. Pat. No. 6,669,767 issued to Blease et al. on Dec. 30, 2003; and U.S. Pat. No. 6,688,739 issued to Murray on Feb. 10, 2004.

Some examples of corona elements that may possibly be utilized or adapted for use in at least one possible embodiment may possibly be found in the following U.S. patents: U.S. Pat. No. 6,951,992, entitled "Corona and static electrode assembly"; U.S. Pat. No. 7,151,902, entitled "Toner transfer technique"; U.S. Pat. No. 6,957,030, entitled "Method and apparatus for making signs"; U.S. Pat. No. 7,153,646, entitled "Photothermographic material"; and U.S. Pat. No. 7,155,150, entitled "Method and apparatus for developing a latent image using toner grains constituting a developer".

Some examples of screen printing apparatus that may possibly be utilized or possibly adapted for use in at least one possible embodiment of the present application may possibly be found in the following U.S. patents: U.S. Pat. No. 5,374,449 issued to Bühlmann et al. on Dec. 20, 1994; U.S. Pat. No. 5,722,321 issued to Szyszko et al. on Mar. 3, 1998; U.S. Pat. No. 6,591,745 issued to Miyahara et al. on Jul. 15, 2003; U.S. Pat. No. 6,601,502 issued to Kamen et al. on Aug. 5, 2003; U.S. Pat. No. 6,619,197 issued to Murakami et al. on Sep. 16, 2003; and U.S. Pat. No. 6,659,005 issued to Takahashi et al. on Dec. 9, 2003.

Some examples of apparatus and methods for the drying and/or hardening of ink that may possibly be utilized or adapted for use in at least one possible embodiment may possibly be found in the following U.S. patents: U.S. Pat. No. 6,493,018, entitled "Wide format thermal printer"; U.S. Pat. No. 6,957,030, entitled "Method and apparatus for making signs"; U.S. Pat. No. 4,970,528, entitled "Method for uniformly drying ink on paper from an ink jet printer"; U.S. Pat. No. 6,312,123, entitled "Method and apparatus for UV ink jet printing on fabric and combination printing and quilting thereby"; and U.S. Pat. No. 6,857,737, entitled "UV ink printed graphic article".

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Jan. 5, 2009, and/or cited elsewhere are hereby incorporated by reference as if set forth in their entirety herein as follows, except for the exceptions indicated herein: US 2005/045053, having the title "Digital can decorating apparatus," published on Mar. 3, 2005; WO 2004/009360, having the following title "PRINTING PROCESS AND APPARATUS," published on Jan. 29, 2004; U.S. Pat. No. 6,769,357, having the title "Digital can decorating apparatus," published on Aug. 3, 2004; EP 0 385 624, having the title "An apparatus for, and a method of, printing a pattern on a container component," published on Sep. 5, 1990; and EP 0 209 896, having the following English translation of the German title "Method and apparatus for decorating metal or plastic containers," published on Jan. 28, 1987.

All of the patents, patent applications or patent publications, which were cited in the German Office Action dated Jun. 23, 2008, and/or cited elsewhere are hereby incorporated by reference as if set forth in their entirety herein as follows, except for the exceptions indicated herein: DE 102006001223, having the following English translation of the German title "Device for printing on bottles or similar receptacles," published on Jul. 12, 2007; DE 102007036752, having the following English translation of the German title "Machine for printing on e.g. bottles has ink-jet printing heads mounted on turntable, around which containers pass during printing stage, individual heads being able to be withdrawn from printing position and replaced by different head," published on Feb. 2, 2009; EP 1435296, having the title "System for printing on items," published on Jul. 7, 2004; US 2006144261, having the title "Printing plastic containers with digital images," published on Jul. 6, 2006; and U.S. Pat. No. 5,207,153, having the title "APPARATUS FOR APPLYING PRINTED MATTER TO OBJECTS," published on May 4, 1993.

The patents, patent applications, and patent publications listed above in the preceding paragraphs are herein incorporated by reference as if set forth in their entirety except for the exceptions indicated herein. The purpose of incorporating U.S. patents, Foreign patents, publications, etc. is solely to provide additional information relating to technical features of one or more embodiments, which information may not be completely disclosed in the wording in the pages of this application. However, words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, and patent publications, are not considered to be incorporated by reference herein.

The corresponding foreign and international patent publication applications, namely, Federal Republic of Germany Patent Application No. 10 2007 036 752.1, filed on Aug. 3, 2007, having inventor Martin SCHACH, and DE-OS 10 2007 036 752.1 and DE-PS 10 2007 036 752.1, Federal Republic of Germany Patent Application No. 10 2007 050 490.1, filed on Oct. 19, 2007, having inventor Martin SCHACH, and DE-OS 10 2007 050 490.1 and DE-PS 10 2007 050 490.1, Federal Republic of Germany Patent Application No. 10 2007 050 493.6, filed on Oct. 19, 2007, having inventor Martin SCHACH, and DE-OS 10 2007 050 493.6 and DE-PS 10 2007 050 493.6, and International Application No. PCT/EP2008/005711, filed on Jul. 12, 2008, having WIPO Publication No. WO 2008/018893 and inventor Martin SCHACH, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein except for the exceptions indicated herein.

The purpose of incorporating the corresponding foreign equivalent patent application(s), that is, PCT/EP2008/005711, German Patent Application 10 2007 036 752.1, German Patent Application 10 2007 050 490.1, and German Patent Application 10 2007 050 493.6, is solely for the purpose of providing a basis of correction of any wording in the pages of the present application, which may have been mistranslated or misinterpreted by the translator. However, words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments of the patents, patent applications, and patent publications, are not generally considered to be incorporated by reference herein.

Statements made in the original foreign patent applications PCT/EP2008/005711, DE 10 2007 036 752.1, DE 10 2007 050 490.1, and DE 10 2007 050 493.6 from which this patent application claims priority which do not have to do with the correction of the translation in this patent application are not to be included in this patent application in the incorporation by reference.

Any statements about admissions of prior art in the original foreign patent applications PCT/EP2008/005711, DE 10 2007 036 752.1, DE 10 2007 050 490.1, and DE 10 2007 050 493.6 are not to be included in this patent application in the incorporation by reference, since the laws relating to prior art in non-U.S. Patent Offices and courts may be substantially different from the Patent Laws of the United States.

All of the references and documents, cited in any of the documents cited herein, are hereby incorporated by reference as if set forth in their entirety herein exception for the exceptions indicated herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1, 1*a*-1*f* Device
2 Container
3 Conveyor
4 Corona tunnel
5 Separating screw
6 Inlet or transport star
7 Rotor
8 Printing station
9 Container support
10, 10*a* Printing group
10.1-10.5 Print head
11 Device for drying the printing ink
12 Outlet or transport star
13 Conveyor
14 Control system
15 Support
16 Transport system
17 Transport section
18, 18*a* Printing group
18.1-18.6 Print head unit
19 Print head
20 Device for drying the printing ink
21 Support
30 Conveyor
31 Corona tunnel
32 Separating screw
33 Inlet or transport star
34 Rotor
35 Outlet or transport star
36 Conveyor
37 Transfer pad
38 Transfer drum
39 Printing group
39.1-39.5 Print head
40 Cleaning station
41 Device for applying a sealing or covering coating
42 Device for drying
43 Control system
44 Transport system
45 Transport section
46 Container support
47 Printing device
48 Transfer pad
49 Auxiliary conveyor
49.1 Upper loop length
50 Cleaning station
51 Printing group
51.1-51.5 Print head
52 Device for applying the sealing or covering coating
53 Device for drying
54 Rotor
55 Container support
56 Print head support
57 Printing group
57.1-57.5 Print head
58 Device for drying
59 Hardener or curing station
T, TS Direction of transport
R Direction of rotation of the rotor
MA Machine axis
TR1, TR2 Pivoting direction of the floating printing group 18

What is claimed is:

1. A device configured and disposed for printing containers in multiple colors on at least one outer surface thereof, said device comprising:

at least one printing group;

at least two print heads disposed in each said printing group, each said print head being an ink jet printer configured to print a part of an image to be printed on the outer surface of a container;

a transport element configured and disposed to move a container and a printing group in a direction of transport during printing; and each said print head in each said printing group being switchable on and switchable off, for a print head change or part print change, wherein one of said at least two print heads disposed in a printing position is movable out of the printing position and another one of said at least two print heads is movable into the printing position.

2. The device according to claim 1 further comprising a container support configured and disposed for rotating a container about its longitudinal axis during printing.

3. The device according to claim 1 wherein each said print head in each said printing group is configured to print in different colors.

4. The device according to claim 1 wherein said transport element has a transport section between a container inlet and a container outlet and is configured to move the containers on the transport section during printing.

5. The device according to claim 1 comprising a plurality of printing groups disposed on said transport element.

6. The device according to claim 1 comprising a dryer associated with each said print group, said dryer being configured for drying printing ink to be applied onto the container's surface with a print head.

7. The device according to claim 1 wherein each said print head in each said print group is adjustable or switchable.

8. The device according to claim 7 wherein each said print head in each said print group is adjustable or switchable on said transport element in a direction of transport and opposite a direction of transport.

9. The device according to claim 1 wherein each said print head in each said print group is pivotable.

10. The device according to claim 1 configured to dispose each said print group with a container to be printed and provide centrifugal forces, generated by the movement of said transport element, in a direction from said print group toward the container to be printed.

11. The device according to claim 1 comprising all of the limitations of a)-aa), wherein a)-aa) are:

a) the device further comprising a container support configured and disposed for rotating a container about its longitudinal axis during printing;

b) the device wherein each said print head in each said printing group is configured to print in different colors;

c) the device wherein said transport element has a transport section between a container inlet and a container outlet and is configured to move the containers on the transport section during printing;

d) the device comprising a plurality of printing groups disposed on said transport element;

e) the device comprising at least one container support disposed on said transport element, each said container support being configured for the receiving a container;

f) the device comprising a dryer associated with each said printing group, said dryer being configured for drying printing ink to be applied onto the container's surface with a print head;

g) the device wherein each said print head in each said printing group is adjustable or switchable;

h) the device wherein each said print head in each said printing group is adjustable or switchable on said transport element in a direction of transport and opposite a direction of transport;

i) the device wherein each said print head in each said printing group is pivotable about an axis thereof that is offset relative to an axis of its container to be printed;

j) the device wherein said transport element comprises an endlessly rotatingly driveable transport element configured to dispose each said printing group with a container to be printed and provide centrifugal forces, generated by the movement of said transport element, in a direction from said printing group toward the container to be printed;

k) the device wherein each said print head comprises a print nozzle configured to be positioned to print within a path of movement of the containers;

l) the device comprising a plurality of said container supports disposed on said transport element, at least one said printing group is associated with each said container support, said device being configured to move each said printing group in a synchronous manner with the movement of said transport element in a first operating stroke out of an initial position and is movable back into the initial position in a second operating stroke, in opposition to the direction of transport of said transport element so that in each first and second operating stroke a container disposed in a container support is printed with an associated part image;

m) the device wherein a distance between adjacent said printing groups is identical to the distance between two adjacent said container supports disposed on said transport element;

n) the device configured for simultaneous printing at least two containers;

o) the device wherein a distance between two said print heads, each in an adjacent printing group, is identical to a distance between two adjacent said container supports on said transport element;

p) the device wherein each said printing group is pivotable by a stroke that corresponds to a machine spacing out of an initial position into an end position and out of the end position back into the initial position, the machine spacing is identical to a distance between axes of two adjacent said container supports on said transport element multiplied by the number of said print heads in each said printing group;

q) the device comprising a dryer for each said print head;

r) the device wherein each said dryer is switchable on and switchable off;

s) the device wherein said transport element is a rotatably driveable transport element and said at least one printing group is disposed inside or outside said transport element;

t) the device comprising a plurality of container supports disposed with said transport element, at least said printing group is provided each said container support, each said print head in each said printing group being configured for generating different part printed images and, during printing, each said print head being configured and disposed to be entrained in the same direction and in a synchronous manner with the movement of said transport element such that at least one said print head in each said printing group is disposed in a printing position at a container, and in that for the print head change, the movement of said printing group or said print heads can be slowed down or accelerated in such a manner and after the print head change can be synchronized again in such a manner with the movement of said transport element that after the print head change one said print head in each said printing group is once again situated in a printing position with its respective container;

u) the device wherein said transport element is a rotor;

v) the device said print heads one said printing group are moveable in a circulating manner on a movement path that is closed per se;

w) the device said print heads are disposed on a rotatably driveable print head support;

x) the device wherein a distance between print heads in adjacent printing groups corresponds to a distance between adjacent said container supports in such a manner that during printing, one said print head in adjacent printing groups is disposed in a printing position with reference to a container;

y) the device wherein the number of said printing groups is identical to the number of said container supports;

z) the device wherein the number of printing groups is an integer multiple of the number of said container supports on said transport element; and aa) the device wherein the number of said container supports on said transport element is an integer multiple of a number of said print heads in one said printing group.

12. A device configured and disposed for printing containers in multiple colors on at least one outer surface thereof, said device comprising:

at least one printing group;

at least two print heads disposed in each said printing group, each said print head being an ink jet printer and configured to print a part of an image on a transfer pad;

said transfer pad configured and disposed to move past said printing group and transfer the image to a container; and a transport element configured and disposed to move the container and said at least one printing group in a direction of transport during printing.

13. A method for printing containers in multiple colors on their container outer surface comprising the steps of:

moving a container with a transport element;

moving a printing group with the transport element;

printing with a first print head in the printing group;

moving the first print head out of a printing position; and moving a second print head in the printing group into the printing position.

14. The method for printing containers of claim 13 further comprising the step of rotating the containers 360 degrees about their axes during printing.

15. The method for printing containers of claim 13 further comprising the step of:

printing with the second print head in the printing group; and wherein said step of printing with a first print head and said step of printing with a second print comprise printing with different colors or materials.

16. The method for printing containers of claim 13 wherein said step of printing with a first print head in the printing group is performed at a printing station on the transport element and the transport element disposes and moves a plurality of printing stations, each printing station comprises a printing group, each printing group has a plurality of print heads, said steps of moving the first print head out of a printing position and moving a second print head in the printing group into the printing position comprises at least one of a)-c), wherein a)-c) are:

a) moving the first and second print heads relative to the printing station in the direction of the direction of transport of the printing station with the transport element;

b) moving the first and second print heads relative to the printing station in the direction opposite the direction of transport of the printing station with the transport element; and c) pivoting or rotating the first and second print heads about an axis.

17. The method for printing containers of claim 13 comprising at least one of the limitations of a)-c), wherein a)-c) are:

a) said steps of moving a container with a transport element and moving a printing group with the transport element cause said step of printing with a first print head to be supported by centrifugal forces that are generated by the movement of the transport element;

b) the method further comprises a step of drying a printed material; and c) the method further comprises a step of moving the printing group out of an initial position in one operating stroke and in one return stroke is moved back into the initial position in opposition to the direction of transport of the transport element.

18. The method for printing containers of claim 13 wherein said printing step comprises printing onto a transfer pad and the method further comprises transferring a printed image from the transfer pad to an outer surface of a container.

19. The method for printing containers of claim 18 wherein containers are moved on the container transport element and the transfer pads are moved with an auxiliary conveyor, during said step of transferring a printed image from the transfer pad to an outer surface of a container.

20. A device configured to perform the method for printing containers of claim 13, said device comprising:

a transport element configured and disposed for moving a container;

a printing group configured and disposed to move with said transport element;

a first print head disposed in said printing group and configured for printing and moving out of a printing position; and a second print head in the printing group being configured to move into the printing position.

* * * * *